US011473748B1

(12) United States Patent
Hong

(10) Patent No.: US 11,473,748 B1
(45) Date of Patent: Oct. 18, 2022

(54) ROTATION LIGHT SOURCE LAMP SYSTEM FOR REDUCING CHROMATIC ABERRATION AND VEHICLE USING THE SAME

(71) Applicants: HYUNDAI MOTOR COMPANY, Seoul (KR); KIA CORPORATION, Seoul (KR)

(72) Inventor: Seung-Pyo Hong, Incheon (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/507,096

(22) Filed: Oct. 21, 2021

(30) Foreign Application Priority Data

May 6, 2021 (KR) ..... 10-2021-0058474

(51) Int. Cl.

| | |
|---|---|
| ***F21S 41/657*** | (2018.01) |
| ***F21S 41/153*** | (2018.01) |
| ***F21S 41/25*** | (2018.01) |
| ***F21S 45/47*** | (2018.01) |
| ***F21S 43/14*** | (2018.01) |
| *F21W 103/15* | (2018.01) |
| *F21Y 115/10* | (2016.01) |
| *F21Y 105/18* | (2016.01) |
| *F21W 107/10* | (2018.01) |
| *F21W 103/35* | (2018.01) |

(52) U.S. Cl.
CPC ..... *F21S 41/657* (2018.01); *F21S 41/153* (2018.01); *F21S 41/25* (2018.01); *F21S 43/14* (2018.01); *F21S 45/47* (2018.01); *F21W 2103/15* (2018.01); *F21W 2103/35* (2018.01); *F21W 2107/10* (2018.01); *F21Y 2105/18* (2016.08); *F21Y 2115/10* (2016.08)

(58) Field of Classification Search
None
See application file for complete search history.

(56) References Cited

FOREIGN PATENT DOCUMENTS

KR 10-2005-0103391 A 10/2005

*Primary Examiner* — Elmito Breval
(74) *Attorney, Agent, or Firm* — Morgan, Lewis & Bockius LLP

(57) ABSTRACT

A rotation light source lamp system is combined with a rotation light source device in which a chromatic aberration correction unit obviates focal distance differences occurring between incident paths "a" of lights emitted by LED light sources sequentially synchronized and turned on when first to N-th LED chips arrive at a location where each LED chip faces a signal transmitter while the first to N-th LED chips are rotated once in response to the application of a lamp turn-on signal for the vehicle from the signal transmitter. Chromatic aberration can be reduced by correcting a difference between refractive indices for each wavelength having a different color in the first to N-th LED chips.

25 Claims, 11 Drawing Sheets

<A-A>

STEP INTERVALS BETWEEN LED CHIPS: D1, D2, D3 OR T1, T2, T3, T4

SEQUENCE OF TURNED-ON LEDS: 60A->60B->60C->60D->60E

STEP INTERVALS BETWEEN LED CHIPS: R1, R2, R3 OR LA, LB, LC

SEQUENCE OF TURNED-ON LEDS: 60A->60B

<A-A>

ROTATION LIGHT SOURCE LAMP SYSTEM FOR REDUCING CHROMATIC ABERRATION AND VEHICLE USING THE SAME

CROSS-REFERENCE TO RELATED APPLICATION

The present application claims priority to Korean Patent Application No. 10-2021-0058474, filed on May 6, 2021, the entire contents of which is incorporated herein for all purposes by this reference.

BACKGROUND OF THE INVENTION

Field of the Invention

The present invention relates to a lamp system, and more particularly, to a vehicle to which a rotation light source lamp system for reducing chromatic aberration by correcting a difference between refractive indices for each wavelength by adjusting the location of a light source for each color is applied.

Description of Related Art

In general, a light-emitting diode (LED) applied as a light source, that is, a lamp for a vehicle, includes an LED chip (or chip LED). In the instant case, the LED chip refers to an LED that generates light upon electrification based on the principle of a PN junction LED.

For example, an LED chip light source lamp may have advantages in that it can improve light source efficiency due to an LED having a reduced size and can efficiently use light because light concentrations at the focus of a reflective surface of a lamp and at the location of an LED chip are increased as the size of an LED chip is reduced.

The LED chip light source lamp can directly implement various beam patterns by selectively turning on a plurality of LED chips because an LED chip array using the plurality of LED chips is implemented. Accordingly, the LED chip light source lamp may be effectively used to implement various beam patterns in a vehicle lamp.

However, the LED chip array inevitably has a limitation in that a chromatic aberration problem occurs in implementing various colors by use of the plurality of LED chips.

Such a chromatic aberration problem results from a difference between optical paths for each wavelength of a color emitted from each of a plurality of LED chips, and cannot be structurally solved in terms of an LED chip array.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY OF PRESENT INVENTION

Various aspects of the present invention are directed to providing a rotation light source lamp system for reducing chromatic aberration, which can reduce chromatic aberration by correcting a difference between refractive indices for each wavelength having a different color in an LED chip array in which LED light sources of a plurality of LED chips having colors are disposed at intervals, and can improve a refractive index correction effect through a difference between front and rear arrays for a violet-series LED having a short wavelength and a red-series LED having a long wavelength among various colors because LEDs sequentially arrived at locations are turned on through the rotation of the plurality of LED chips, in particular, and a vehicle using the same.

In various exemplary embodiments of the present invention, a rotation light source lamp system includes an optical member, and a rotation light source device in which each of first to N-th light-emitting diode (LED) chips forming a circular array forms focal distance differences for the optical member, wherein the N is an integer equal to or greater than 2, wherein the focal distance differences enable incident paths of LED light sources which arrive at a location where each of the first to N-th LED chips faces a signal transmitter and are sequentially turned on while the first to N-th LED chips are rotated once to be directed toward one point forming a focus of the optical member, and forms a single output path in the optical member.

As various exemplary embodiments of the present invention, the focal distance differences are formed by a chromatic aberration correction unit using an LED circuit unit, first to N-th chip grooves in which the first to N-th LED chips are disposed, respectively, are formed in an external diameter of the LED circuit unit, the first to N-th chip grooves have different depths, and the first to N-th LED chips have external diameter PCB thickness differences for the external diameter and form the chromatic aberration correction unit.

As various exemplary embodiments of the present invention, the external diameter PCB thickness differences are set to bring the incident paths of the LED light sources of the first to N-th LED chips into the focus of the optical member.

As various exemplary embodiments of the present invention, the LED circuit unit is connected to a rotation apparatus of receiving a rotational force from a power source which is driven by a current applied through a lamp turn-on signal for a vehicle from the signal transmitter and is rotated along with the rotation apparatus. The signal transmitter transmits an LED chip synchronization signal along with the current applied to the LED circuit unit so that light of an LED of an LED chip arriving at the location among the first to N-th LED chips is generated during the one rotation.

As various exemplary embodiments of the present invention, the focal distance differences are formed by a chromatic aberration correction unit using an LED circuit unit. The chromatic aberration correction unit forms internal diameter PCB thickness differences in an internal diameter of the LED circuit unit or forward protrusion steps in one of a front flat panel, a front convex cone, and a front concave cone of the LED circuit unit.

As various exemplary embodiments of the present invention, the internal diameter PCB thickness differences and the forward protrusion steps are set so that the first to N-th LED chips bring the incident paths of the LED light sources into the focus of the optical member.

As various exemplary embodiments of the present invention, the internal diameter PCB thickness differences are formed by first to N-th chip grooves in which the first to N-th LED chips are disposed, respectively, based on the internal diameter of the LED circuit unit. The first to N-th chip grooves have different depths so that the first to N-th LED chips have protrusion height differences for the internal diameter, respectively.

As various exemplary embodiments of the present invention, the forward protrusion steps are formed in first to N-th chip grooves in which the first to N-th LED chips are disposed, respectively, based on the front flat panel provided in one portion of the LED circuit unit. The first to N-th chip grooves have different depths so that the first to N-th LED chips have protrusion height differences for the front flat panel, respectively.

As various exemplary embodiments of the present invention, the forward protrusion steps are formed in first to N-th chip grooves in which the first to N-th LED chips are disposed, respectively, based on the front convex cone or the front concave cone provided in one portion of the LED circuit unit. The first to N-th chip grooves have different depths so that the first to N-th LED chips have protrusion height differences for the front flat panel, respectively.

As various exemplary embodiments of the present invention, the focal distance differences are formed by a chromatic aberration correction unit using an LED circuit unit. The chromatic aberration correction unit forms LED front and rear distance differences or LED radius distance differences in front of the LED circuit unit.

As various exemplary embodiments of the present invention, the LED front and rear distance differences and the LED radius distance differences are set so that the first to N-th LED chips bring the incident paths of the LED light sources into the focus of the optical member, respectively.

As various exemplary embodiments of the present invention, the LED front and rear distance differences include relative distance differences between a plurality of front distances in which the first to N-th LED chips are disposed, respectively, based on the external diameter of the LED circuit unit. The relative location differences include front and rear distance differences for the front of the LED circuit unit.

As various exemplary embodiments of the present invention, the LED radius distance differences include relative radius differences between a plurality of radius distance differences for the first to N-th LED chips formed in a front convex cone or a front concave cone provided in one portion of the LED circuit unit. The relative radius differences include radius differences for a center portion of the LED circuit unit.

As various exemplary embodiments of the present invention, the focal distance differences are formed by a chromatic aberration correction unit using an LED circuit unit and a heat transfer member. The chromatic aberration correction unit form any one of external diameter LED protrusion height differences of the first to N-th LED chips using the heat transfer member attached to an external diameter of the LED circuit unit, internal diameter LED protrusion height differences of the first to N-th LED chips using the heat transfer member attached to an internal diameter of the LED circuit unit, and LED front protrusion height differences of the first to N-th LED chips using the heat transfer member attached to a front flat panel, a front convex cone or a front concave cone of the LED circuit unit.

As various exemplary embodiments of the present invention, each of the external diameter LED protrusion height differences, the internal diameter LED protrusion height differences, and the LED front protrusion height differences is set so that the first to N-th LED chips bring the incident paths of the LED light sources into the focus of the optical member, respectively.

As various exemplary embodiments of the present invention, the heat transfer member forms the external diameter LED protrusion height differences, the internal diameter LED protrusion height differences, and the LED front protrusion height differences by use of first to N-th heat transfer members matched with the first to N-th LED chips, respectively.

As various exemplary embodiments of the present invention, each of the first to N-th heat transfer members includes a heat sink. The heat sink dissipates heat generated by the first to N-th LED chips.

As various exemplary embodiments of the present invention, the optical member includes one of an aspherical lens, a low pressure injection lens, and a light guide.

Furthermore, in various exemplary embodiments of the present invention, a vehicle includes a rotation light source lamp system in which a chromatic aberration correction unit is included in an LED circuit unit in which first to N-th LED chips (N is an integer equal to or greater than 2) having incident paths focused on one point of an optical member including any one of an aspherical lens, a low pressure injection lens, and a light guide are circularly arranged, wherein the chromatic aberration correction unit forms focal distance differences between the optical member and each of LED light sources which arrive at a location where each of the first to N-th LED chips faces a signal transmitter and is sequentially turned on while the first to N-th LED chips are rotated once based on one of thickness differences, steps, distance differences, and height differences, and brings the incident paths into a focus of the optical member based on the focal distance differences.

As various exemplary embodiments of the present invention, the thickness differences include external diameter PCB thickness differences for an external diameter of the LED circuit unit or internal diameter PCB thickness differences for an internal diameter of the LED circuit unit.

As various exemplary embodiments of the present invention, the steps include forward protrusion steps formed in one of a front flat panel, a front convex cone, and a front concave cone which shield one portion of the LED circuit unit.

As various exemplary embodiments of the present invention, the distance differences include LED front and rear distance differences forming relative location differences between the first to N-th LED chips in an external diameter of the LED circuit unit or LED radius distance differences forming relative radius differences between the first to N-th LED chips in a front convex cone provided in one portion of the LED circuit unit.

As various exemplary embodiments of the present invention, the height differences are formed by a heat transfer member to which the first to N-th LED chips are attached in one of an external diameter and an internal diameter of the LED circuit unit and a front flat panel, a front convex cone, and a front concave cone which shield one portion of the LED circuit unit.

As various exemplary embodiments of the present invention, the rotation light source lamp system is one of a head lamp, a tail lamp, a stop lamp, a side marker lamp, a high mounted stop lamp (HMSL), and an urban air mobility (UAM) lamp.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
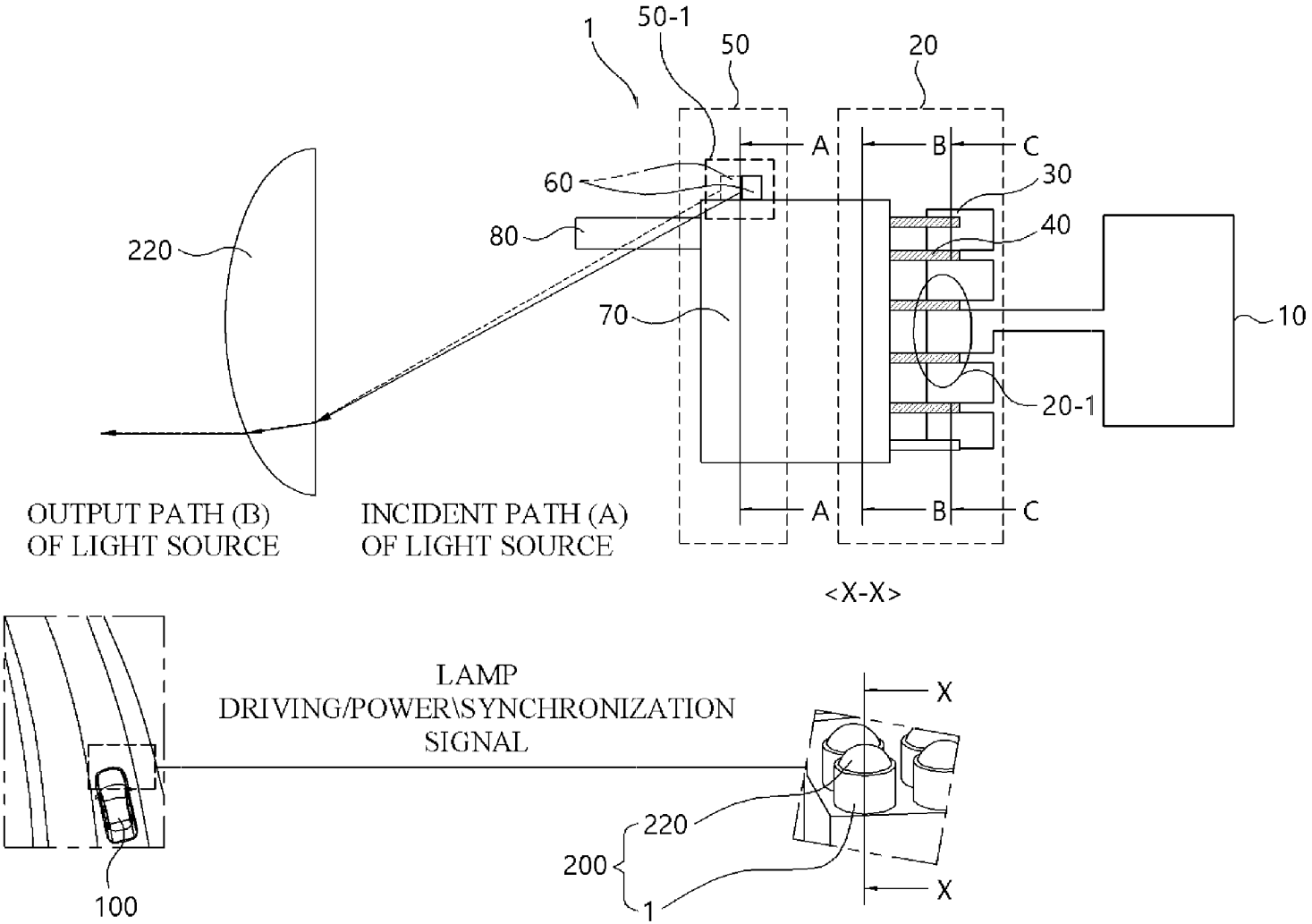
FIG. 1 illustrates an example of a vehicle to which a rotation light source lamp system for reducing chromatic aberration according to various exemplary embodiments of the present invention has been applied.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Embodiments of the present invention will be described in detail below with reference to the accompanying drawings. Such embodiments are examples of the present invention and may be implemented in various other different forms by those skilled in the art to which various exemplary embodiments of the present invention pertains, and the present invention is not limited to these embodiments.

Referring to FIG. 1, a rotation light source lamp system 200 for a vehicle 100 includes a rotation light source device 1 and an optical member 220. In the instant case, the rotation light source lamp system 200 is illustrated as a head lamp for a vehicle. Furthermore, hereinafter, a focal distance difference means a light source-incident path difference, that is, a difference between incident paths "a" of light sources of respective LED chips of the LED module 60 based on a difference between wavelengths of the LED chips for each color. The focus of the optical member 220 means the same light source-incident point at which the incident paths "a" of light sources of respective LED chips gather.

For example, in the rotation light source device 1, as the LED circuit unit 70 of the LED module 60 is rotated by a rotational force of a rotation apparatus 20 connected to a power source 10, a plurality of LEDs of the LED module 50 is turned on in response to a synchronization signal and power of a signal transmitter 80. The incident paths "a" (e.g., refer to a broken line arrow and a solid line arrow) of the light sources are matched with the optical member 220 so that a chromatic aberration phenomenon of a wavelength when a chromatic aberration correction unit 50-1 reaches at the same location does not occur due to a difference between optical paths of light emitted from at least two other LEDs.

Therefore, when the rotation light source lamp system 200 operates in response to lamp driving/power/synchronization signals generated from the vehicle 100, the power/synchronization signals of the lamp driving/power/synchronization signals are provided as power for driving the power source 10 and turning on the LED module 60 through the signal transmitter 80 of the rotation light source device 1.

For example, the optical member 220 generates lighting of the rotation light source lamp system 200 by transmitting, as along one light source output path "b", light sources of the LED chips 60 having the light source-incident path "a."

The optical member 220 includes any one of an aspherical lens, a low pressure injection lens, and a light guide, and is disposed in front of the LED circuit unit 70. The low pressure injection lens has a flat straight line or concave or convex surface and adjusts a total reflection performance of light, and is directly associated with a corresponding LED chip from which light emits. Accordingly, the low pressure injection lens can have small weight and a low production cost because a size for concentrating lights of LED light sources may be adjusted to be small.

Accordingly, the rotation light source lamp system 200 is characterized as a rotation light source lamp system for reducing chromatic aberration using the chromatic aberration correction unit 50-1.

Furthermore, in the rotation light source lamp system 200, the LED module 60 generates lighting patterns having various colors of consecutive LED light sources. Due to an advantage of such lighting patterns having various colors, the rotation light source lamp system 200 may be applied as a lamp having a lighting pattern, such as a tail lamp, a stop lamp, a side marker lamp, or a high mounted stop lamp (HMSL), or a lamp suitable for a lighting pattern necessary for an urban air mobility (UAM) lamp, in addition to the head lamp.

Figure 2:
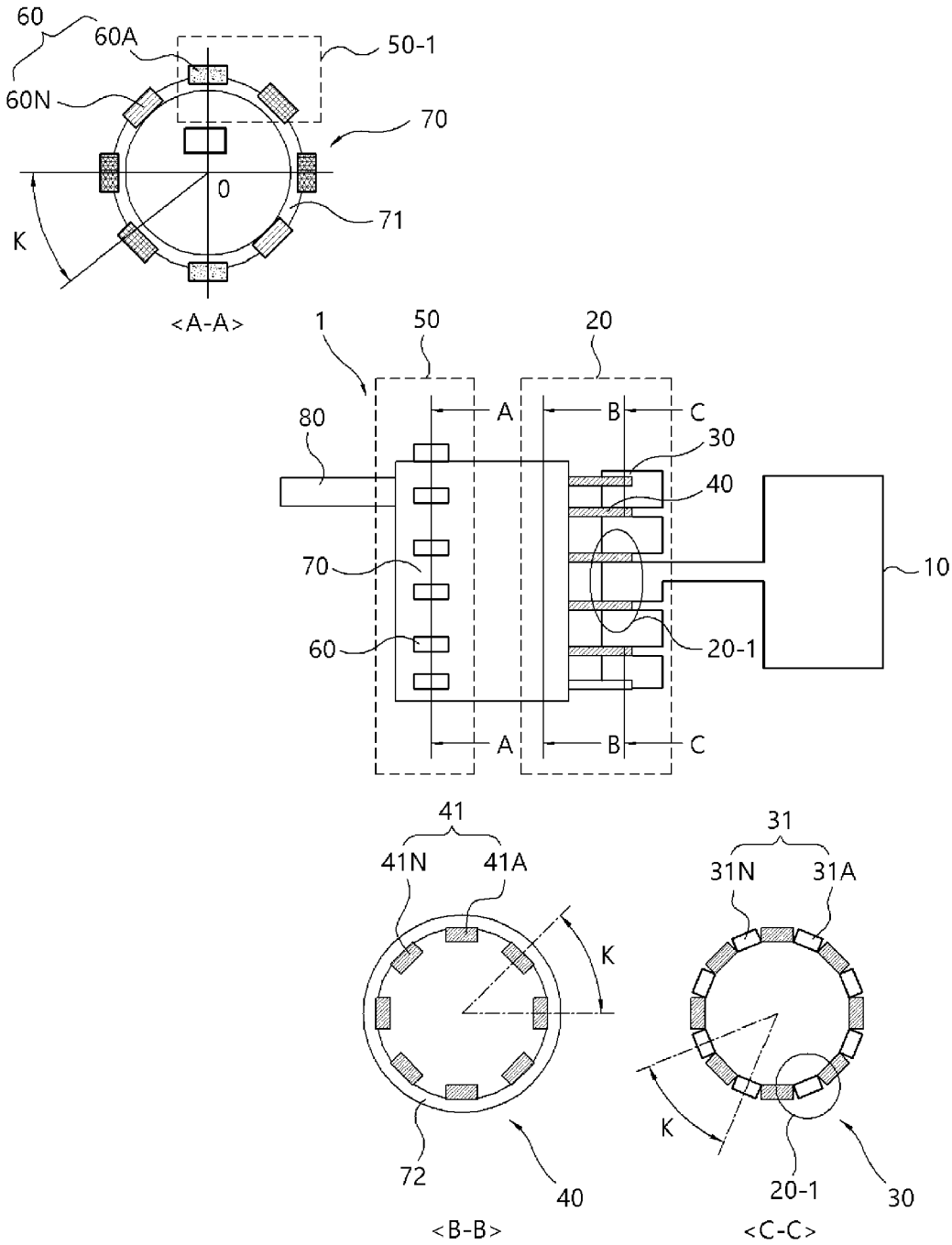
FIG. 2 illustrates a construction of a rotation light source device in which a chromatic aberration correction unit according to various exemplary embodiments of the present invention has been applied to an LED module.

FIG. 2 illustrates a detailed configuration of the rotation light source device 1.

As illustrated, the signal transmitter 80 of the rotation light source device 1 provides an LED synchronization signal which is provided as power for driving the power source 10 and turning on the LED module 60 and that sequentially synchronizes LED chips each arriving at a location where the LED chip faces the signal transmitter 80, among first to N-th LED chips 60A, 60B, 60C, 60D, 60E, 60F, 60G, and 60N, while the LED circuit unit 70 is rotated once by a rotational force transmitter 30 of the rotation apparatus 20 and the signal transmitter 80.

In particular, specific LED chips at locations where the LED chips face each other may include one or more of the first to N-th LED chips 60A, 60B, 60C, 60D, 60E, 60F, 60G, and 60N. Accordingly, the number of specific LED chips or LEDs turned on at synchronized rotation locations or near a boundary of the synchronized rotation locations may be one or two or more.

Hereinafter, the number of each of first to N-th insertion legs 31A to 31N of the rotational force transmitter 30, first to N-th fixed legs 41A to 41N of a rotational force receiver 40, and first to N-th LED chips 60A, 60B, 60C, 60D, 60E, 60F, 60G, and 60N of the LED chip 60 is illustrated as being eight, but this is one example. Accordingly, the number may be smaller than or greater than eight.

For example, the power source 10 applies a motor thereto and rotates the rotation apparatus 20. To the present end, the power source 10 forms an assembly structure with the rotational force transmitter 30 of the rotation apparatus 20 or forms a structure integrated with the rotational force transmitter 30 in order to rotate the rotational force transmitter 30. In the instant case, the power source 10 includes an electric circuit along with the signal transmitter 80 for power supply and driving.

For example, the rotation apparatus 20 is rotated by the power source 10, thus rotating the LED module 50. To the present end, the rotation apparatus 20 includes the rotational force transmitter 30 and the rotational force receiver 40.

In a cross section C-C, the rotational force transmitter 30 includes an insertion leg 31 having a hollow cylinder structure. The insertion leg 31 includes the plurality of first to N-th insertion legs 31A to 31N (N is an integer equal to or greater than 2) having an interval therebetween so that the first to N-th insertion legs form a circular cross section.

In a cross section B-B, the rotational force receiver 40 includes a fixed leg 41 having a hollow cylinder structure. The fixed leg 41 includes the plurality of first to N-th fixed legs 41A to 41N (N is an integer equal to or greater than 2) having an interval therebetween so that the first to N-th fixed legs form a circular cross section.

As a result, the rotational force transmitter 30 and the rotational force receiver 40 form an assembly state in which the insertion leg 31 of the rotational force transmitter 30 and the fixed leg 41 of the rotational force receiver 40 are coaxially arranged, and form, in some section of the entire length, a matching state (refer to the cross section C-C) in which the first to N-th insertion legs 31A to 31N of the insertion leg 31 and the first to N-th fixed legs 41A to 41N of the fixed leg 41 are inserted into the intervals of the other party, respectively, forming a circular rotation section 20-1.

Therefore, the circular rotation section 20-1 delivers the rotation of the rotational force transmitter 30 by the power source 10 to the rotational force receiver 40, so that the LED circuit unit 70 of the LED module 50 integrated therewith by fixing one end portion of the rotational force receiver 40 may be rotated.

The circular rotation section 20-1 may be changed into a concentric circle rotation section in which the power source 10 and the rotation apparatus 20 are implemented using a BLDC motor method or a DE motor method and the power source 10 and the rotation apparatus 20 are substituted with a single integrated BLDC motor and a cross-concentric circle rotation section in which the power source 10 and the rotation apparatus 20 are substituted with one BLDC motor and the power supply function of the signal transmitter 80 is removed by a self-production power supply method using an electromagnetic force of an induced coil.

For example, the LED module 50 includes the LED chip 60 and the LED circuit unit 70. The LED chip 60 and the LED circuit unit 70 include the chromatic aberration correction unit 50-1.

In a cross section A-A, the LED circuit unit 70 has a hollow cylinder structure having a circular cross section. The LED chip 60 is attached to the external diameter 71 of the LED circuit unit 70 and connected to an electric circuit of the LED circuit unit 70. In the instant case, the first to N-th LED chips 60A, 60B, 60C, 60D, 60E, 60F, 60G, and 60N of the LED chip 60 are configured as an external array layout.

To the present end, the LED chip 60 includes the first to N-th LED chips 60A, 60B, 60C, 60D, 60E, 60F, 60G, and 60N (N is an integer equal to or greater than 2). The first to N-th LED chips 60A, 60B, 60C, 60D, 60E, 60F, 60G, and 60N have an interval therebetween and are attached to the external diameter 71 of the LED circuit unit 70. The LED circuit unit 70 is fabricated using a printed circuit board (PCB) and has the electric circuit for supplying power and transmitting and receiving signals embedded therein. The electric circuit of the PCB includes a power and signal circuit for generating a synchronization signal in response to a signal transmitted by the signal transmitter 80.

In particular, each of the first to N-th LED chips 60A, 60B, 60C, 60D, 60E, 60F, 60G, and 60N constituting the LED chip 60 has the same structure and operation as a common LED chip. In the instant case, as in FIG. 2, each of the first to N-th LED chips 60A, 60B, 60C, 60D, 60E, 60F, 60G, and 60N can increase a luminous flux and improve high light efficiency by use of a characteristic in which the luminous flux of an LED is increased by a rise of a current (e.g., 3A) which may be applied.

Moreover, referring to the cross sections A-A, B-B, and C-C, the first to N-th insertion legs 31A to 31N of the rotational force transmitter 30, the first to N-th fixed legs 41A to 41N of the rotational force receiver 40, and the first to N-th LED chips 60A, 60B, 60C, 60D, 60E, 60F, 60G, and 60N of the LED chip 60 have the same interval-forming angle K. The same interval-forming angle K provides conformity between mutual rotation angles. In the instant case, the interval-forming angle K is about 45°, but may be set to 30° or 60° smaller or greater than 45°. The interval-forming angle K varies depending on the number of LED chips.

In the cross section A-A, in the chromatic aberration correction unit 50-1, each of the first to N-th LED chips 60A, 60B, 60C, 60D, 60E, 60F, 60G, and 60N of the LED chip has focal distance differences with respect to the focus of the optical member 220. The focal distance differences are described by differently forming protrusion heights of the first to N-th LED chips 60A, 60B, 60C, 60D, 60E, 60F, 60G, and 60N with respect to the LED circuit unit 70.

Therefore, the chromatic aberration correction unit 50-1 can increase a correction effect caused by a difference between refractive indices in a way that a violet-series LED having a short wavelength is located in the front and a red-series LED having a long wavelength is located in the rear with respect to the first to N-th LED chips 60A, 60B, 60C, 60D, 60E, 60F, 60G, and 60N by use of distance differences of the first to N-th LED chips 60A, 60B, 60C, 60D, 60E, 60F, 60G, and 60N of the LED chip with respect to the focus of the optical member 220 or protrusion height differences of the first to N-th LED chips 60A, 60B, 60C, 60D, 60E, 60F, 60G, and 60N with respect to the LED circuit unit 70.

For example, the signal transmitter 80 is disposed perpendicularly to the center portion O of the circular cross section from an inside space of the LED circuit unit 70 (i.e., the internal diameter 72 of the LED circuit unit 70) to the outside of the LED circuit unit 70, and applies a current to one LED through subsequent power in the state in which the one LED chip is synchronized with and faces the signal transmitter 80 among the first to N-th LED chips 60A, 60B, 60C, 60D, 60E, 60F, 60G, and 60N of the LED chip 60. In the instant case, the signal transmitter 80 is fabricated using the PCB, and has embedded therein the electric circuit for power supply necessary to receive a signal from the outside (i.e., a lamp controller) and transmit the signal to the LED circuit unit 70 and for signal transmission.

To the present end, the signal transmitter 80 is configured in a form of a pole including a power line and a signal line therein and having a provided length. The signal transmitter 80 may form a fixed state by being coupled to a housing or reception connector of the rotation light source device 1 or the lamp housing of a lamp system (refer to FIG. 8).

The signal transmitter 80 generates a transmission signal, including a power source (or power) and a synchronization signal divided from a signal received from the outside, and is synchronized with an LED chip that reaches a location where the LED chip faces the signal transmitter 80 through the LED circuit unit 70, among the first to N-th LED chips 60A, 60B, 60C, 60D, 60E, 60F, 60G, and 60N, in response to the received synchronization signal, while providing power to the power source 10, the LED chip 60, and the LED circuit unit 70 through a power signal using power received through a control signal from a controller or through a manipulation button, so that the power can be applied to the corresponding LED.

Therefore, the signal transmitter 80 synchronizes the first to N—the LED chips 60A, 60B, 60C, 60D, 60E, 60F, 60G, and 60N of the LED chip 60, each arriving at a location where the signal transmitter 80 faces the LED chip while the LED circuit unit 70 of the LED module 50 is rotated once by the rotational force receiver 40 of the rotation apparatus 20 so that the LED chips each are sequentially turned on at the location, so that the first to N-th LED chips 60A, 60B, 60C, 60D, 60E, 60F, 60G, and 60N may continuously generate lights of LED light sources.

Figure 3:
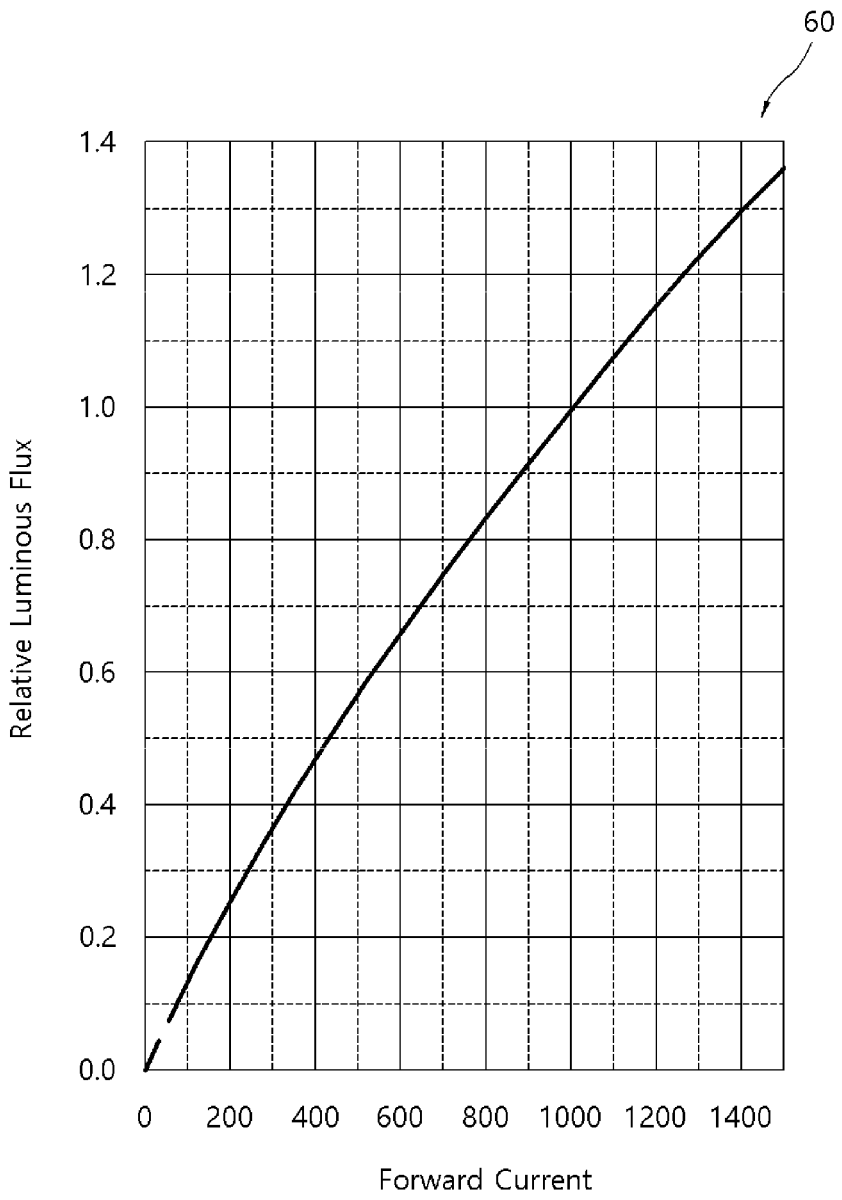
FIG. 3 illustrates an example of an applied current and relative luminous flux line diagram of an LED chip according to various exemplary embodiments of the present invention.

As may be seen from the graph illustrating the current and luminous flux of the LED in FIG. 3, the signal transmitter 80 implements operation control in a way that one of the first to N-th LED chips 60A, 60B, 60C, 60D, 60E, 60F, 60G, and 60N is used for a short time and the other of the first to N-th LED chips 60A, 60B, 60C, 60D, 60E, 60F, 60G, and 60N is used again by use of a characteristic of the first to N-th LED chips 60A, 60B, 60C, 60D, 60E, 60F, 60G, and 60N having a higher luminous flux as a higher current is applied and setting a turn-on time to be short by applying a high current to an LED chip or LED turned on at a synchronized rotation location.

As a result, the rotation light source device 1 can improve light efficiency by use of the characteristic in which the luminous flux is increased due to an increase in the current of each of the first to N-th LED chips 60A, 60B, 60C, 60D, 60E, 60F, 60G, and 60N under the same condition, can obviate a separate concentration structure for gathering lights of LED light sources due to improved light efficiency, and can implement a characteristic in which the size of a light focus can be reduced by obviating the concentration structure.

Figure 4:
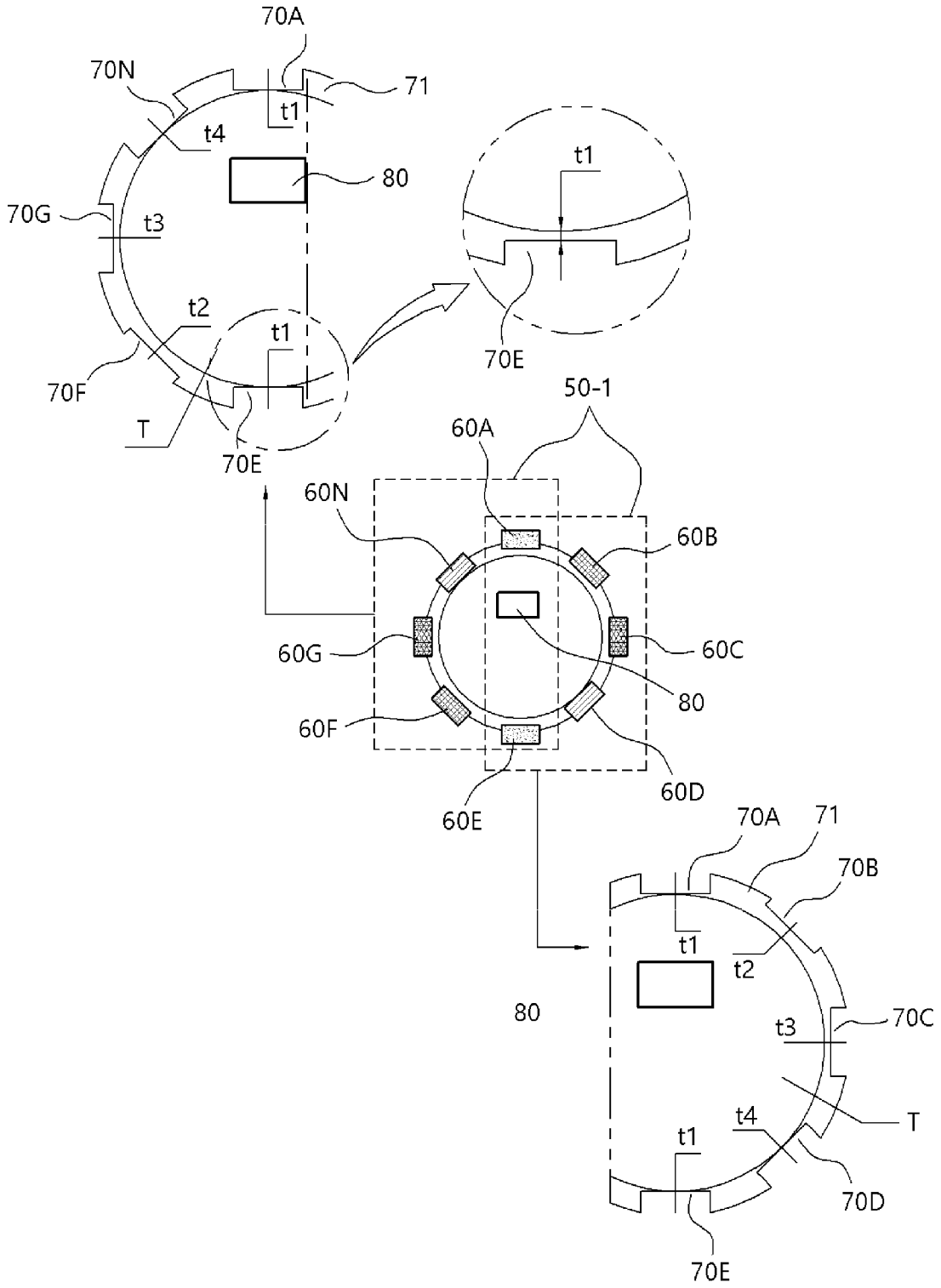
FIG. 4 illustrates an example in which the chromatic aberration correction unit according to various exemplary embodiments of the present invention has PCB thickness differences in the external diameter of an LED circuit unit constituting the LED module.

Referring to FIG. 4, in the chromatic aberration correction unit 50-1, PCB thickness differences are formed because first to N-th chip grooves 70A, 70B, 70C, 70D, 70E, 70F, 70G, and 70N of the LED circuit unit 70 are formed to have different depths. Accordingly, the first to N-th LED chips 60A, 60B, 60C, 60D, 60E, 60F, 60G, and 60N attached to the first to N-th chip grooves 70A, 70B, 70C, 70D, 70E, 70F, 70G, and 70N, respectively, are formed to have different protrusion heights.

To the present end, the first to N-th chip grooves 70A, 70B, 70C, 70D, 70E, 70F, 70G, and 70N are formed in the external diameter 71 of the LED circuit unit 70. The second to N-th chip grooves 70B, 70C, 70D, 70E, 70F, 70G, and 70N are sequentially formed at the same interval-forming angle K (refer to FIG. 3) as the first to N-th LED chips 60A, 60B, 60C, 60D, 60E, 60F, 60G, and 60N by use of the first chip groove 70A as a start location. Accordingly, the first to N-th chip grooves 70A, 70B, 70C, 70D, 70E, 70F, 70G, and 70N are provided in the circular circumference of the external diameter 71.

The first to N-th chip grooves 70A, 70B, 70C, 70D, 70E, 70F, 70G, and 70N of the chromatic aberration correction unit 50-1 are formed in the entire section in a left and right symmetry (or up and down symmetry) manner with respect to the circular cross section of the LED circuit unit 70 because the first chip groove 70A and the fifth chip groove 70E, the second chip groove 70B and the sixth chip groove 70F, the third chip groove 70C and the seventh chip groove 70G, and the fourth chip groove 70D and the N-th chip groove 70N face each other.

For example, assuming that the depth of each of the first chip groove 70A and the fifth chip groove 70E is formed to have a first PCB thickness "t1" as a basis, the depth of each of the second chip groove 70B and the sixth chip groove 70F is formed to have a second PCB thickness "t2", the depth of each of the third chip groove 70C and the seventh chip groove 70G is formed to have a third PCB thickness "t3", and the depth of each of the depth of each of the fourth chip groove 70D and the N-th chip groove 70N is formed to have a fourth PCB thickness "t4."

The first PCB thickness "t1", the second PCB thickness "t2", the third PCB thickness "t3" and the fourth PCB thickness "t4" have different values so that the first to N-th LED chips 60A, 60B, 60C, 60D, 60E, 60F, 60G, and 60N attached to the first to N-th chip grooves 70A, 70B, 70C, 70D, 70E, 70F, 70G, and 70N, respectively, have different protrusion heights. In the instant case, the sizes of the first, second, third, and fourth PCB thicknesses "t1", "t2", "t3", and "t4" may be set as t2>t3>t1>t4 (wherein ">" is an inequality sign indicative of a mathematical relationship between two values), but may be changed based on colors of LED light sources applied to the first to N-th LED chips 60A, 60B, 60C, 60D, 60E, 60F, 60G, and 60N.

As a result, in the chromatic aberration correction unit 50-1, PCB thickness differences are formed in the PCB thickness T of the LED circuit unit 70 due to the first, second, third, and fourth PCB thicknesses "t1", "t2", "t3", and "t4" of the first to N-th chip grooves 70A, 70B, 70C, 70D, 70E, 70F, 70G, and 70N having different depths.

As described above, the chromatic aberration correction unit 50-1 solves an aspect in which a focal location for each wavelength cannot be structurally changed into a focal location where a path difference between light sources having various colors is fine and similar depending on a wavelength by use of a rotation light source in which the LED circuit unit 70 having the circular cross section and the first to N-th LED chips 60A, 60B, 60C, 60D, 60E, 60F, 60G, and 60N forming a circular array are combined.

The reason for this is that, in the case of the rotation light source, LEDs having various colors can form different focuses at similar locations and thus the results of light sources of the first to N-th LED chips 60A, 60B, 60C, 60D, 60E, 60F, 60G, and 60N constituting the circular array for each color can reduce chromatic aberration through the same output light path (i.e., the incident path "a" of a light source in FIG. 1) because different light sources may not be present in one space at the same time, but may be used with time differences based on rotation.

Therefore, when lights are generated from the LEDs of the first to N-th LED chips 60A, 60B, 60C, 60D, 60E, 60F, 60G, and 60N of the LED chip sequentially arriving at locations where the signal transmitter 80 surfaces the first to N-th LED chips 60A, 60B, 60C, 60D, 60E, 60F, 60G, and 60N while the LED circuit unit 70 is rotated once, the location of a light source for each color is adjusted based on the LED protrusion height difference of each of the first to N-th LED chips 60A, 60B, 60C, 60D, 60E, 60F, 60G, and 60N having the PCB thickness differences. Accordingly, the chromatic aberration correction unit 50-1 reduces or obviates chromatic aberration in the incident path "a" of a light source (refer to FIG. 1), that is, a difference between optical paths of various colors of the first to N-th LED chips 60A, 60B, 60C, 60D, 60E, 60F, 60G, and 60N for each wavelength, each one turned on at the location where the LED chip faces the signal transmitter 80, in the optical member 220 (refer to FIG. 1) as in the results of the output path "b" (refer to FIG. 1) of a light source.

Figure 5:
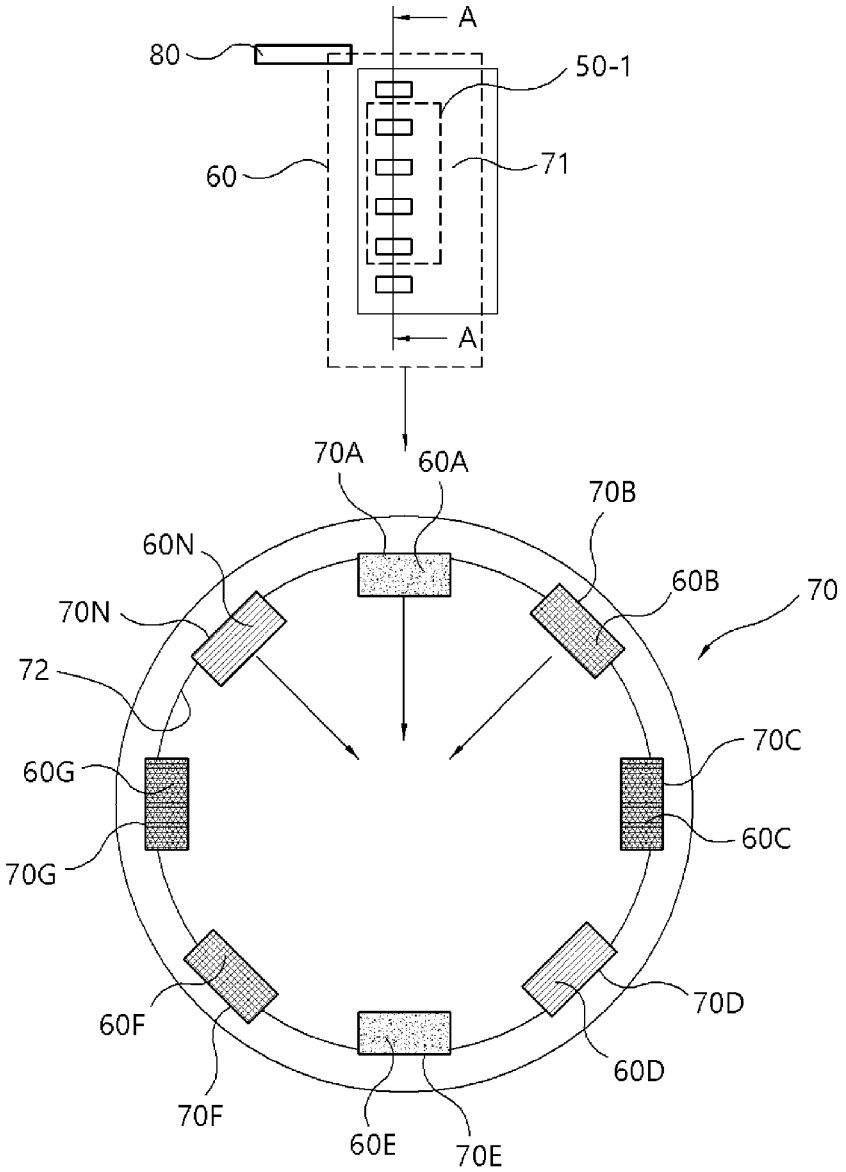
FIG. 5 illustrates an example in which the chromatic aberration correction unit according to various exemplary embodiments of the present invention has PCB thickness differences in the internal diameter of the LED circuit unit constituting the LED module.
Figure 6:
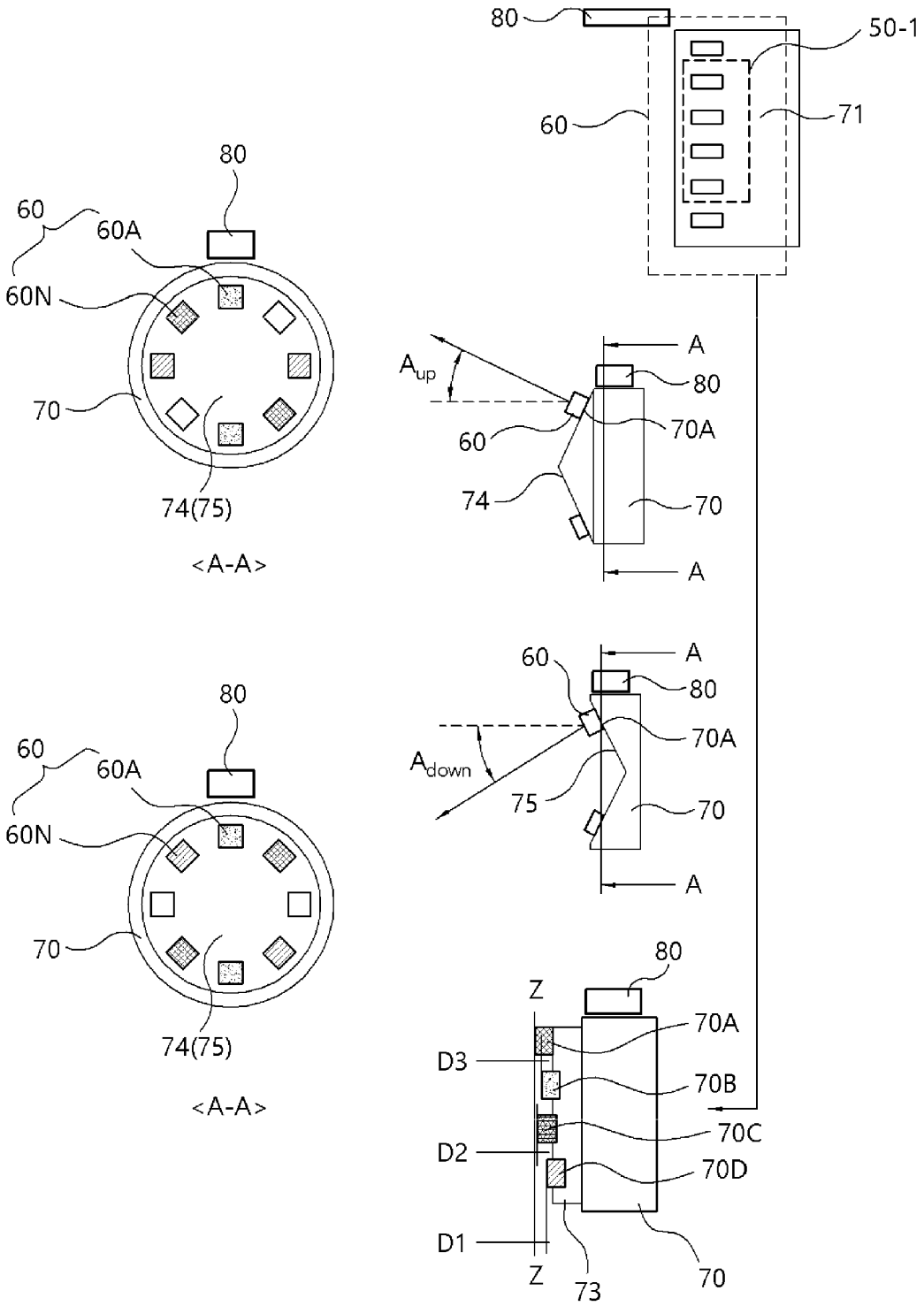
FIG. 6 illustrates an example in which the chromatic aberration correction unit according to various exemplary embodiments of the present invention has a forward protrusion step in the front of the LED circuit unit constituting the LED module.
Figure 7:
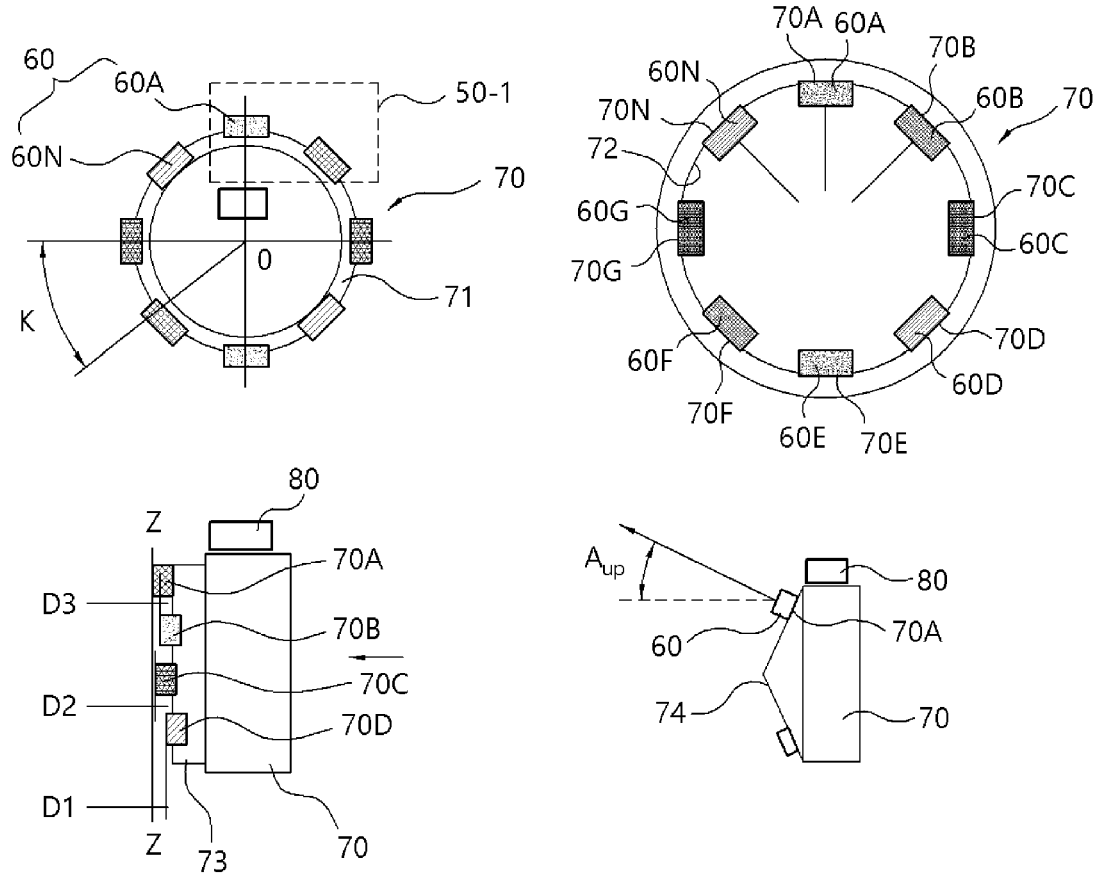
FIG. 7 illustrates an operating state of a rotation light source lamp system configured for lighting not having chromatic aberration based on any one of external diameter PCB thickness differences, internal diameter PCB thickness differences, and forward protrusion steps according to various exemplary embodiments of the present invention.
Figure 7:
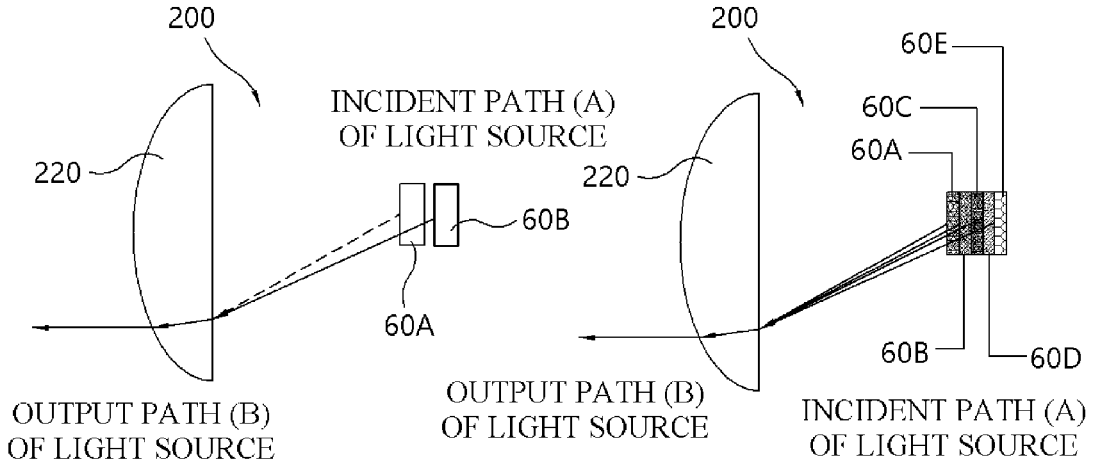

FIG. 5, FIG. 6 and FIG. 7 illustrate examples in which the chromatic aberration correction unit 50-1 has PCB thickness differences by use of the internal diameter and front of the LED circuit unit 70. In the instant case, the signal transmitter 80 is disposed perpendicularly to the center portion O (refer to FIG. 3) of the circular cross section from the external diameter 71 of the LED circuit unit 70 to the outside of the LED circuit unit 70, so that a current is applied to a corresponding LED through subsequent power in the state in which one LED chip of the first to N-th LED chips 60A, 60B, 60C, 60D, 60E, 60F, 60G, and 60N is synchronized with and faces the signal transmitter 80.

Referring to FIG. 5, in the chromatic aberration correction unit 50-1, the first to N-th chip grooves 70A, 70B, 70C, 70D, 70E, 70F, 70G, and 70N are formed in the internal diameter 72 of the LED circuit unit 70. In the first to N-th chip grooves 70A, 70B, 70C, 70D, 70E, 70F, 70G, and 70N, the second to N-th chip grooves 70B, 70C, 70D, 70E, 70F, 70G, and 70N are sequentially formed to have the same interval-forming angle K (refer to FIG. 3) as the first to N-th LED chips 60A, 60B, 60C, 60D, 60E, 60F, 60G, and 60N by use of the first chip groove 70A as a start location, and are provided in the circular circumference of the internal diameter 72.

Therefore, although the chromatic aberration correction unit 50-1 is formed in the internal diameter 72 of the LED circuit unit 70, as in the external diameter 71, the PCB thickness T of the LED circuit unit 70 has PCB thickness differences due to the same depth and first, second, third, and fourth PCB thicknesses "t1", "t2", "t3", and "t4" of the first to N-th chip grooves 70A, 70B, 70C, 70D, 70E, 70F, 70G, and 70N.

As a result, like the chromatic aberration correction unit 50-1 having external diameter PCB thickness differences of the external diameter 71 of the LED circuit unit 70, the chromatic aberration correction unit 50-1 having internal diameter PCB thickness differences of the internal diameter 72 of the LED circuit unit 70 can reduce or obviate chromatic aberration in the incident path "a" of a light source (refer to FIG. 1), that is, a difference between optical paths of various colors of the turned-on first to N-th LED chips 60A, 60B, 60C, 60D, 60E, 60F, 60G, and 60N for each wavelength in the optical member 220 (refer to FIG. 1), as in the results of the output path "b" (refer to FIG. 1) of a light source.

Additionally, the first to N-th LED chips 60A, 60B, 60C, 60D, 60E, 60F, 60G, and 60N are attached to the first to N-th chip grooves 70A, 70B, 70C, 70D, 70E, 70F, 70G, and 70N formed in the internal diameter 72 of the LED circuit unit 70, respectively. Unlike in a case where the first to N-th LED chips 60A, 60B, 60C, 60D, 60E, 60F, 60G, and 60N are attached to the external diameter 72, lights of LED light sources that illustrate the inside of the LED circuit unit 70 can be collected in the internal diameter 72.

FIG. 6 illustrates that the chromatic aberration correction units 50-1 are formed in the front flat panel 73, front convex cone 74 and front concave cone 75 of the LED circuit unit 70.

For example, the front flat panel 73 includes a circular plate. One portion of the circular cross section of the LED circuit unit 70 is blocked, so that the first to N-th chip grooves 70A, 70B, 70C, 70D, 70E, 70F, 70G, and 70N of the chromatic aberration correction unit 50-1 are formed in the front of the front flat panel 73.

Furthermore, the front convex cone 74 includes a cone for upward tilting light of an LED light source at an upward cone tilt angle $A_{up}$. One portion of the circular cross section of the LED circuit unit 70 is blocked, so that the first to N-th chip grooves 70A, 70B, 70C, 70D, 70E, 70F, 70G, and 70N of the chromatic aberration correction unit 50-1 are formed in the front of the front convex cone 74. Furthermore, the front concave cone 75 includes a cone for downward tilting light of an LED light source at a downward cone tilt angle Adown. One portion of the circular cross section of the LED circuit unit 70 is blocked, so that the first to N-th chip grooves 70A, 70B, 70C, 70D, 70E, 70F, 70G, and 70N of the chromatic aberration correction unit 50-1 are formed in the front of the front convex cone 74.

Therefore, in each of the chromatic aberration correction unit 50-1 applied to the front flat panel 73, the chromatic aberration correction unit 50-1 applied to the front convex cone 74, and the chromatic aberration correction unit 50-1 applied to the front concave cone 75, the second to N-th chip grooves 70B, 70C, 70D, 70E, 70F, 70G, and 70N are sequentially formed at the same interval-forming angle K (refer to FIG. 3) as the first to N-th LED chips 60A, 60B, 60C, 60D, 60E, 60F, 60G, and 60N by use of the first chip groove 70A as the start location. Accordingly, the first to N-th chip grooves 70A, 70B, 70C, 70D, 70E, 70F, 70G, and 70N protrude toward the front of the LED circuit unit 70 with respective forward protrusion steps.

For example, assuming that a protrusion reference location Z-Z of the first LED chip 60A based on the depth of the first chip groove 70A is the forefront location, the forward protrusion steps of the chromatic aberration correction unit 50-1 include a first forward protrusion step D1 of the second LED chip 60B based on the depth of the second chip groove 70B, a second forward protrusion step D2 of the third LED chip 60C based on the depth of the third chip groove 70C, and a third forward protrusion step D3 of the fourth LED chip 60D based on the depth of the fourth chip groove 70D.

The first forward protrusion step D1, the second forward protrusion step D2, and the third forward protrusion step D3 have different values with respect to the protrusion reference location Z-Z. Accordingly, the first to N-th LED chips 60A, 60B, 60C, 60D, 60E, 60F, 60G, and 60N attached to the first to N-th chip grooves 70A, 70B, 70C, 70D, 70E, 70F, 70G, and 70N, respectively, have different forward protrusion steps.

In the instant case, the sizes of the first, second, and third forward protrusion steps D1, D2, and D3 are set as D2>D1>D3 (wherein ">" is an inequality sign indicative of a mathematical relationship between two values), but may be changed based on colors of LED light sources applied to the first to N-th LED chips 60A, 60B, 60C, 60D, 60E, 60F, 60G, and 60N.

Therefore, although the chromatic aberration correction unit 50-1 protrudes to the front of the LED circuit unit 70, the first, second, and third forward protrusion steps D1, D2, and D3 having the same function as the first, second, third, and fourth PCB thicknesses "t1", "t2", "t3", and "t4" of the external diameter 71 and the internal diameter 72 are formed in the LED circuit unit 70.

Additionally, the first to N-th LED chips 60A, 60B, 60C, 60D, 60E, 60F, 60G, and 60N applied to the front flat panel 73 of the LED circuit unit 70 are directed toward the front. Accordingly, the optical axes of the first to N-th LED chips 60A, 60B, 60C, 60D, 60E, 60F, 60G, and 60N can be matched with the rotation axes because the first to N-th LED chips 60A, 60B, 60C, 60D, 60E, 60F, 60G, and 60N are configured in parallel to the rotation direction of the rotation apparatus 20.

Furthermore, the first to N-th LED chips 60A, 60B, 60C, 60D, 60E, 60F, 60G, and 60N applied to the front convex cone 74 of the LED circuit unit 70 are upward tilted. Accordingly, lights of LED light sources may be gathered or spread because the first to N-th LED chips 60A, 60B, 60C, 60D, 60E, 60F, 60G, and 60N have provided angles toward the outside of the LED circuit unit 70 with respect to the rotation direction of the LED circuit unit 70. Furthermore, the first to N-th LED chips 60A, 60B, 60C, 60D, 60E, 60F, 60G, and 60N applied to the front concave cone 75 of the LED circuit unit 70 are downward tilted. Accordingly, lights of LED light sources may be gathered or spread because the first to N-th LED chips 60A, 60B, 60C, 60D, 60E, 60F, 60G, and 60N have provided angles toward the inside of the LED circuit unit 70 with respect to the rotation direction of the LED circuit unit 70.

FIG. 7 illustrates that lighting having reduced chromatic aberration or not having chromatic aberration in the optical member 220 is performed by applying any one of the external diameter PCB thickness differences "t1", "t2", "t3", and "t4" of FIG. 4, the internal diameter PCB thickness differences "t1", "t2", "t3", and "t4" of FIG. 5, and the forward protrusion steps D1, D2, and D3 of FIG. 6 to the chromatic aberration correction unit 50-1 of the rotation light source device 1 located behind the optical member 220 in the rotation light source lamp system 200.

For example, the first to N-th LED chips 60A, 60B, 60C, 60D, 60E, 60F, 60G, and 60N are sequentially synchronized and turned on at a location where each of the first to N-th LED chips faces the signal transmitter 80 while the LED circuit unit 70 is rotated once. In the present process, light emitted by the first LED chip 60A which is synchronized and turned on and faces the signal transmitter 80, among the first to N-th LED chips 60A, 60B, 60C, 60D, 60E, 60F, 60G, and 60N, during the one rotation of the LED circuit unit 70 enters the optical member 200 along the incident path "a" and then exits along the output path "b." After the first LED chip 60A, light emitted by the second LED chip 60B which is synchronized and turned on and faces the signal transmitter 80, among the first to N-th LED chips 60A, 60B, 60C, 60D, 60E, 60F, 60G, and 60N, during the one rotation of the LED circuit unit 70, enters the optical member 200 along the incident path "a" and then exits along the output path "b."

Accordingly, if the external diameter PCB thickness differences "t1", "t2", "t3", and "t4" and the internal diameter PCB thickness differences "t1", "t2", "t3", and "t4" are applied to the chromatic aberration correction unit 50-1, the first LED chip 60A forms the incident path "a" at the first PCB thickness "t1" of the first chip groove 70A, whereas the second LED chip 60B forms the incident path "a" at the second PCB thickness "t2" of the second chip groove 70B subsequently to the first LED chip 60A. Accordingly, the incident path "a" of the first LED chip 60A and the incident path "a" of the second LED chip 60B are formed to have a light source-incident path difference between the PCB thickness differences (t2>t3>t1>t4) based on the first PCB thickness "t1" and the second PCB thickness "t2."

As a result, the light source-incident path difference between the PCB thickness differences (t2>t3>t1>t4) can reduce or obviate chromatic aberration because the single output path "b" is formed in the optical member 200 by bringing focuses on the optical member 200 together.

Furthermore, if the forward protrusion steps D1, D2, and D3 are applied to the chromatic aberration correction unit 50-1, the first LED chip 60A forms the incident path "a" at the forefront location based on the protrusion reference location Z-Z of the first chip groove 70A. The second LED chip 60B forms the incident path "a" with the first forward protrusion step D1 of the second chip groove 70B subsequently to the first LED chip 60A. Next, the third LED chip 60C forms the incident path "a" with the second forward protrusion step D2 of the third chip groove 70C subsequently to the second LED chip 60B. The fourth LED chip 60D forms the incident path "a" with the third forward protrusion step D3 of the fourth chip groove 70D subsequently to the third LED chip 60C.

As described above, the light source paths "a" formed by the first, second, third, and fourth LED chips 60A, 60B, 60C, and 60D, respectively, are formed to have a light source-incident path difference between the forward protrusion steps (D2>D1>D3) based on the first, second, and third forward protrusion steps D1, D2, and D3 with respect to the protrusion reference location Z-Z.

As a result, the light source-incident path difference between the forward protrusion steps (D2>D1>D3) can reduce or obviate chromatic aberration because the single output path "b" is formed in the optical member 200 by bringing focuses on the optical member 200 together.

Figure 8:
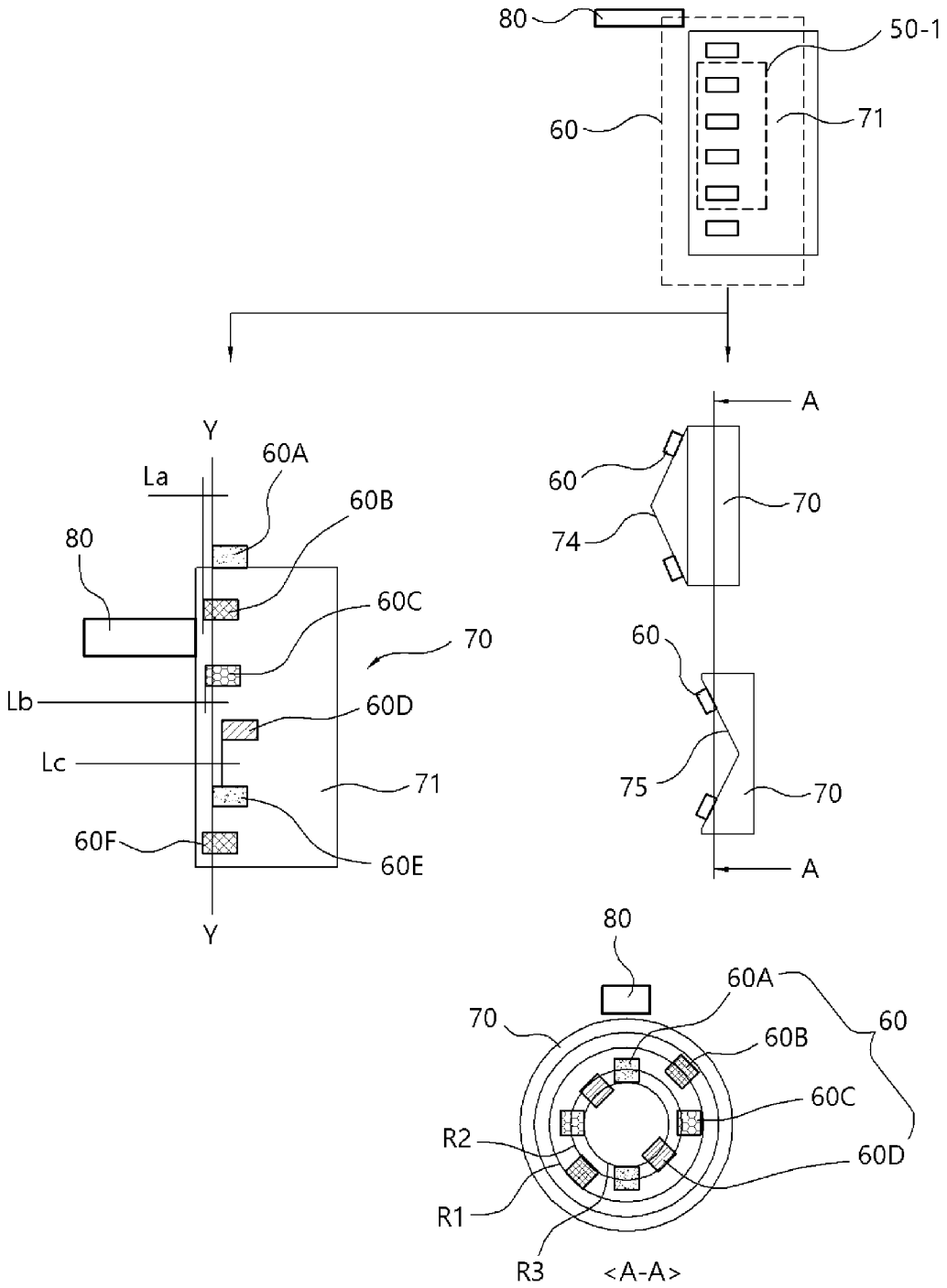
FIG. 8 illustrates an example in which the chromatic aberration correction unit according to various exemplary embodiments of the present invention has LED front and rear distance differences in the external diameter of the LED circuit unit constituting the LED module or LED radius distance differences in the front of the LED circuit unit.
Figure 9:
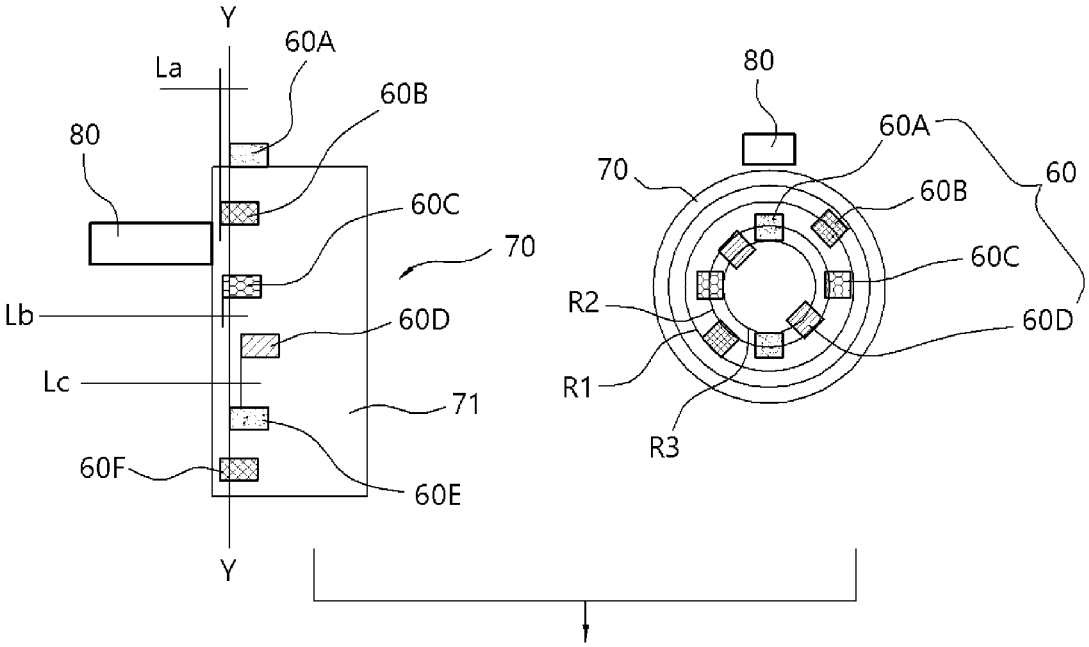
FIG. 9 illustrates an operating state of the rotation light source lamp system configured for lighting not having chromatic aberration based on LED front and rear distance differences or LED radius distance differences according to various exemplary embodiments of the present invention.
Figure 9:
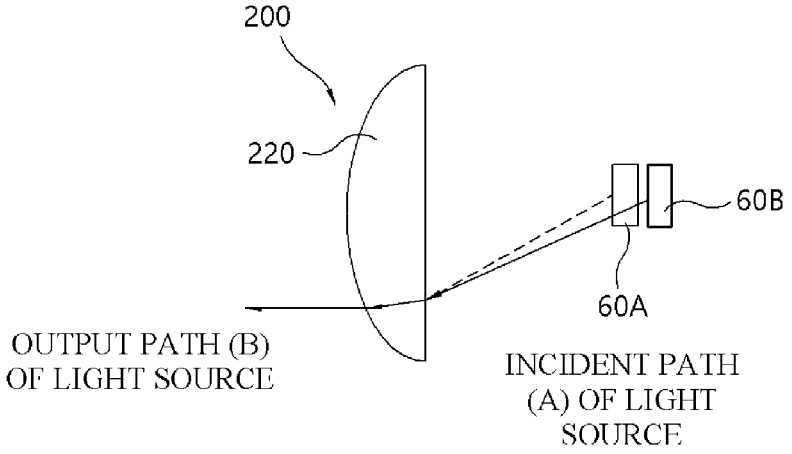

FIG. 8 and FIG. 9 illustrate examples in which the chromatic aberration correction unit 50-1 has LED front and rear distance differences or LED radius distance differences in the front thereof.

In relation to the LED front and rear distance differences, FIG. 8 illustrates that the chromatic aberration correction unit 50-1 has the LED front and rear distance differences for the front of the LED circuit unit 70 by adjusting locations where the first to N-th LED chips 60A, 60B, 60C, 60D, 60E, 60F, 60G, and 60N are attached in the external diameter 71 of the LED circuit unit 70.

For example, assuming that the LED front reference distance Y-Y of the first LED chip 60A is a forefront location, the LED front and rear distance differences are formed to include a first front distance La of the second LED chip 60B, a second front distance Lb of the third LED chip 60C, and a third front distance Lc of the fourth LED chip 60D.

The first front distance La, the second front distance Lb, and the third front distance Lc have different values with respect to the LED front reference distance Y-Y, so that the first to N-th LED chips 60A, 60B, 60C, 60D, 60E, 60F, 60G, and 60N have different front distance locations with respect to the front of the LED circuit unit 70. In the instant case, the LED front and rear distance differences between the first, second, and third front distances La, Lb, and Lc are set as La>Lc>Lb (wherein ">" is an inequality sign indicative of a mathematical relationship between two values), but may be changed based on colors of LED light sources applied to the first to N-th LED chips 60A, 60B, 60C, 60D, 60E, 60F, 60G, and 60N.

In relation to the LED radius distance differences, FIG. 8 illustrates that the chromatic aberration correction unit 50-1 has the LED radius distance differences for the center portion O (refer to FIG. 3) in the front of the LED circuit unit 70 by adjusting locations where the first to N-th LED chips 60A, 60B, 60C, 60D, 60E, 60F, 60G, and 60N are attached in the front convex cone 74 and front concave cone 75 of the LED circuit unit 70.

For example, assuming that a middle LED radius distance R1 of the first LED chip 60A (or the third LED chip 60C) is a basis, the LED radius distance differences include an external LED radius distance R2 of the second LED chip 60B and an internal LED radius distance R3 of the fourth LED chip 60D.

The external LED radius distance R2 and the internal LED radius distance R3 have different values with respect to the middle LED radius distance R1, so that the first to N-th LED chips 60A, 60B, 60C, 60D, 60E, 60F, 60G, and 60N have different front distance locations with respect to a tilt of the front convex cone 74 or front concave cone 75 of the LED circuit unit 70, which has a conical shape. In the instant case, an LED radius distance interval between the middle/outer/inner LED radius distances R1, R2, and R3 is set as R2>R1>R3 (wherein ">" is an inequality sign indicative of a mathematical relationship between two values), but may be changed based on colors of LED light sources applied to the first to N-th LED chips 60A, 60B, 60C, 60D, 60E, 60F, 60G, and 60N.

FIG. 9 illustrates that in the rotation light source lamp system 200, lighting having reduced chromatic aberration or not having chromatic aberration in the optical member 220 is performed by applying the LED front and rear distance differences or LED radius distance differences of FIG. 8 to the chromatic aberration correction unit 50-1 of the rotation light source device 1 disposed at the back of the optical member 220.

For example, the first to N-th LED chips 60A, 60B, 60C, 60D, 60E, 60F, 60G, and 60N that are sequentially synchronized and arrive at a location where each of the LED chips faces the signal transmitter 80 are turned on, while the LED circuit unit 70 is rotated once. In the present process, light emitted by the first LED chip 60A which is synchronized and turned on and faces the signal transmitter 80 during the one rotation of the LED circuit unit 70, among the first to N-th LED chips 60A, 60B, 60C, 60D, 60E, 60F, 60G, and 60N, enters the optical member 200 along the incident path "a" and then exits along the output path "b." After the first LED chip 60A, light emitted by the second LED chip 60B which is synchronized and turned on and faces the signal transmitter 80 during the one rotation of the LED circuit unit 70, among the first to N-th LED chips 60A, 60B, 60C, 60D, 60E, 60F, 60G, and 60N, enters the optical member 200 along the incident path "a" and then exits along the output path "b." In the instant case, two or more LED chips may be turned on to form respective incident paths having a fine difference in the boundary portion of the same respective locations.

Accordingly, if the LED front and rear distance differences La, Lc, and Lb are applied to the chromatic aberration correction unit 50-1, the first LED chip 60A forms the incident path "a" based on the first front distance La, whereas the second LED chip 60B forms the incident path "a" based on the second front distance Lb at the back of the first LED chip 60A.

As a result, the incident path "a" of the first LED chip 60A and the incident path "a" of the second LED chip 60B are formed to have a light source-incident path difference between the LED front and rear distance differences (La>Lc>Lb) based on the first front distance La and the second front distance Lb.

As a result, the light source-incident path difference between the LED front and rear distance differences (La>Lc>Lb) can reduce or obviate chromatic aberration because the single output path "b" is formed in the optical member 200 by bringing focuses on the optical member 200 together.

Furthermore, if the LED radius distance differences R1, R2, and R3 are applied to the chromatic aberration correction unit 50-1, the first LED chip 60A forms the incident path "a" based on the middle LED radius distance R1, whereas the second LED chip 60B forms the incident path "a" based on the external LED radius distance R2 above the first LED chip 60A. In the instant case, two or more LED chips may be turned on to form respective incident paths having a fine difference in the boundary portion of the same respective locations.

As a result, the incident path "a" of the first LED chip 60A and the incident path "a" of the second LED chip 60B are formed to have a light source-incident path difference between the LED radius distance differences (R2>R1>R3) based on the middle LED radius distance R1 and the external LED radius distance R2.

As a result, the light source-incident path difference between the LED radius distance differences (R2>R1>R3) can reduce or obviate chromatic aberration because the single output path "b" is formed in the optical member 200 by bringing focuses on the optical member 200 together.

Figure 10:
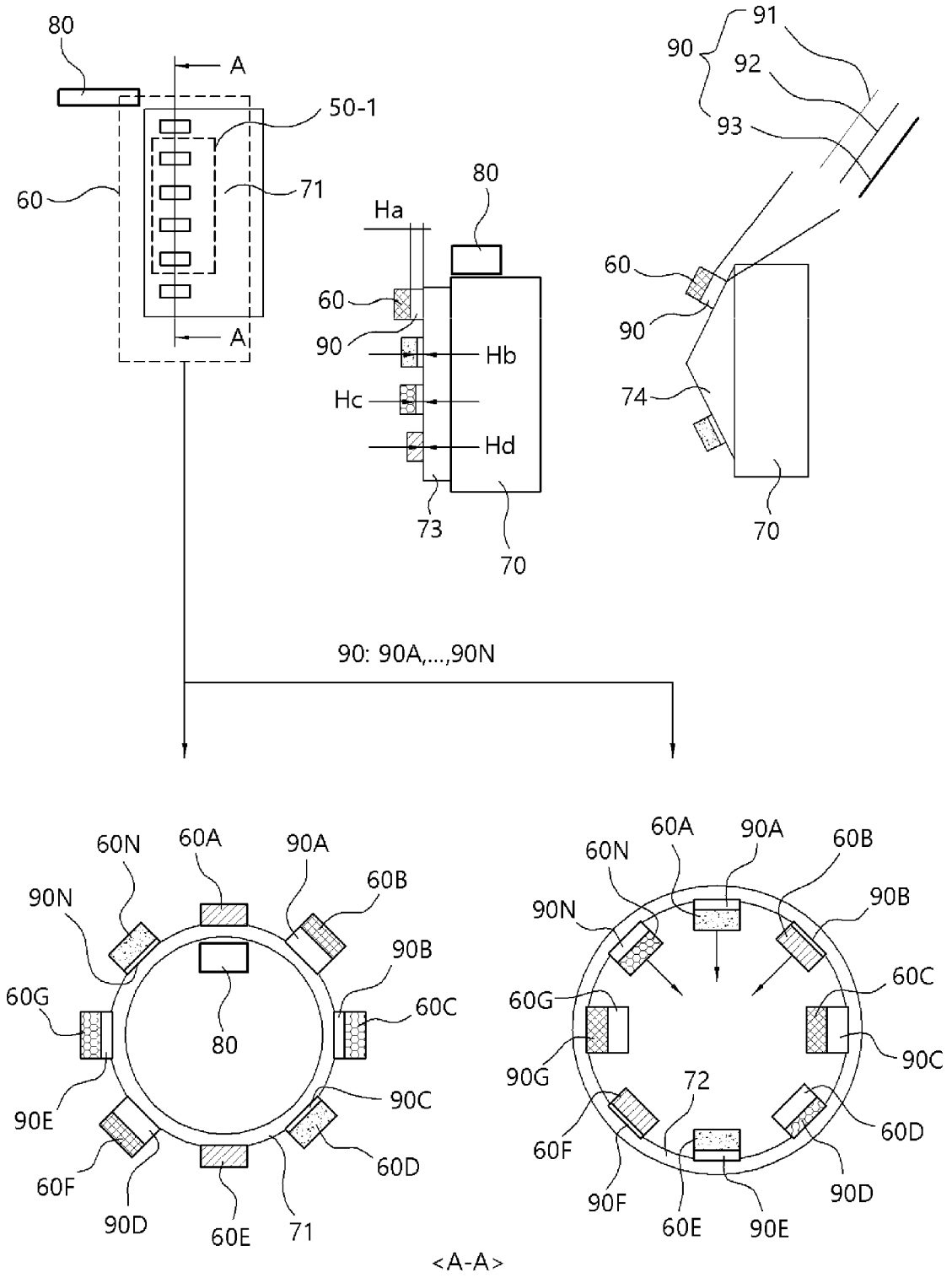
FIG. 10 illustrates an example in which the chromatic aberration correction unit according to various exemplary embodiments of the present invention has LED protrusion height differences through a combination with heat transfer members having different thicknesses in any one portion of the external diameter, internal diameter, and front of the LED circuit unit constituting the LED module.
Figure 11:
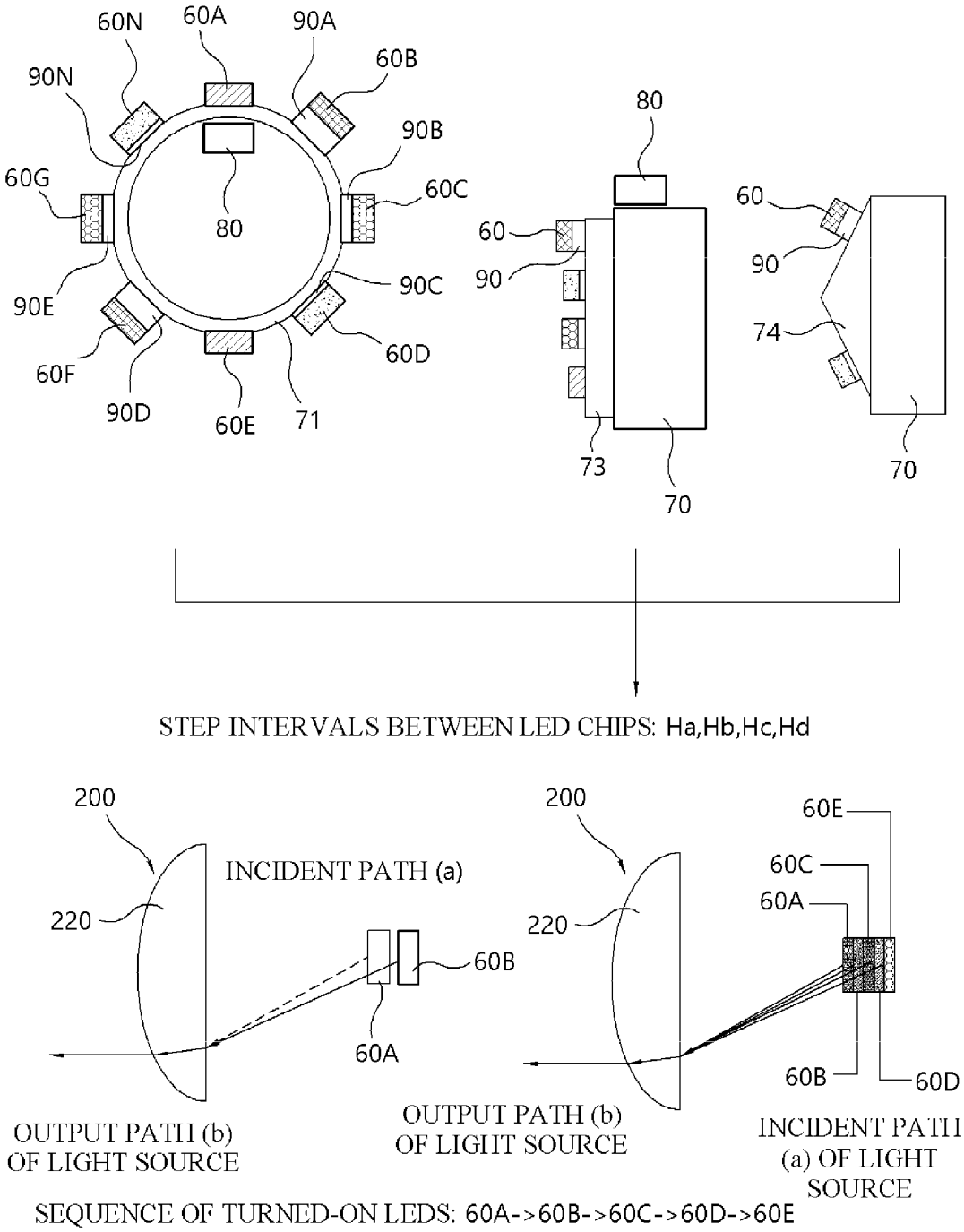
FIG. 11 illustrates an operating state of the rotation light source lamp system configured for lighting not having chromatic aberration based on any one of external diameter LED protrusion height differences, internal diameter LED protrusion height differences, and LED front protrusion height differences according to various exemplary embodiments of the present invention.

FIG. 10, and FIG. 11 illustrate that the chromatic aberration correction unit 50-1 has the LED protrusion height differences (i.e., the external diameter LED protrusion height difference, the internal diameter LED protrusion height difference, and the LED front protrusion height difference) through a combination with a heat transfer member 90.

The heat transfer member 90 includes a heat sink 91, a base plate 92, and a binder 93 and is formed by integrating the heat sink 91/base plate 92/binder 93 into one unit. The heat transfer member 90 includes a plurality of first to N-th heat transfer members 90A, 90B, 90C, 90D, 90E, 90F, 90G, and 90N attached to the first to N-th LED chips 60A, 60B, 60C, 60D, 60E, 60F, 60G, and 60N, respectively.

For example, the heat sink 91 dissipates heat generated by the first to N-th LED chips 60A, 60B, 60C, 60D, 60E, 60F, 60G, and 60N. The base plate 92 is integrated with the heat sink 91 and fixes the heat sink 91 to the first to N-th LED chips 60A, 60B, 60C, 60D, 60E, 60F, 60G, and 60N.

Furthermore, the binder 93 fixes the base plate 92 to a surface of the external diameter 71 or internal diameter 72 or front flat panel 73 or the front convex cone 74 (or the front concave cone 75) of the LED circuit unit 70. In the instant case, the binder 93 may be used to fix the heat sink 91 and the first to N-th LED chips 60A, 60B, 60C, 60D, 60E, 60F, 60G, and 60N.

For example, the first to N-th heat transfer members 90A, 90B, 90C, 90D, 90E, 90F, 90G, and 90N are attached instead of the first to N-th chip grooves 70A, 70B, 70C, 70D, 70E, 70F, 70G, and 70N (refer to FIG. 4) formed in the external diameter 71 of the LED circuit unit 70 in the case of the external diameter LED protrusion height difference, instead of the first to N-th chip grooves 70A, 70B, 70C, 70D, 70E, 70F, 70G, and 70N (refer to FIG. 5) formed in the internal diameter 72 of the LED circuit unit 70 in the case of the internal diameter LED protrusion height difference, and instead of the first to N-th chip grooves 70A, 70B, 70C, 70D, 70E, 70F, 70G, and 70N (refer to FIG. 6) formed in the front flat panel 73 or front convex cone 74 (or the front concave cone 75) of the LED circuit unit 70 in the case of the LED front protrusion height difference. Therefore, the first to N-th heat transfer members 90A, 90B, 90C, 90D, 90E, 90F, 90G, and 90N have different thicknesses (or heights) in a way to form the LED protrusion height differences Ha, Hb, Hc, and Hd.

That is, among the first to N-th heat transfer members 90A, 90B, 90C, 90D, 90E, 90F, 90G, and 90N, the first heat transfer member 90A (and the fifth heat transfer member 90E) has the first thickness Ha, the second heat transfer member 90B (and the sixth heat transfer member 90F) has the second thickness Hb, the third heat transfer member 90C (and the seventh heat transfer member 90G) has the third thickness Hc, and the fourth heat transfer member 90D (and the eighth heat transfer member 90N) has the fourth thickness Hd. The second thickness Hb, the third thickness Hc, and the fourth height Hd have different sizes with respect to the first thickness Ha. In the instant case, thickness differences between the first, second, third, and fourth thicknesses Ha, Hb, Hc, and Hd are set as Ha>Hc>Hb>Hd (wherein ">" is an inequality sign indicative of a mathematical relationship between two values), but may be changed based on colors of LED light sources applied to the first to N-th LED chips 60A, 60B, 60C, 60D, 60E, 60F, 60G, and 60N.

Therefore, although the first to N-th heat transfer members 90A, 90B, 90C, 90D, 90E, 90F, 90G, and 90N having the LED protrusion height differences Ha, Hb, Hc, and Hd are used, the chromatic aberration correction unit 50-1 can generate lighting having reduced chromatic aberration or not having chromatic aberration in the optical member 220, as in the case where any one of the external diameter PCB thickness differences "t1", "t2", "t3", and "t4" of FIG. 4, the internal diameter PCB thickness differences "t1", "t2", "t3", and "t4" of FIG. 5, the forward protrusion steps D1, D2, and D3 of FIG. 6, and the LED front and rear distance differences La, Lb, and Lc or the LED radius distance differences R1, R2, and R3 of FIG. 8 is applied to the chromatic aberration correction unit 50-1.

FIG. 11 illustrates that in the rotation light source lamp system 200, lighting having reduced chromatic aberration or not having chromatic aberration in the optical member 220 is performed by applying the LED protrusion height differences Ha, Hb, Hc, and Hd of FIG. 10 to the chromatic aberration correction unit 50-1 of the rotation light source device 1 disposed at the back of the optical member 220.

For example, the first to N-th LED chips 60A, 60B, 60C, 60D, 60E, 60F, 60G, and 60N sequentially face the signal transmitter 80, and are synchronized and turned on while the LED circuit unit 70 is rotated once.

In the present process, light emitted by the first LED chip 60A which is synchronized with and faces the signal transmitter 80, among the first to N-th LED chips 60A, 60B, 60C, 60D, 60E, 60F, 60G, and 60N, during the one rotation of the LED circuit unit 70 enters the optical member 200 along the incident path "a" and then exits along the output path "b." After the first LED chip 60A, light emitted by the second LED chip 60B which is synchronized and turned on and surfaces the signal transmitter 80, among the first to N-th LED chips 60A, 60B, 60C, 60D, 60E, 60F, 60G, and 60N, during the one rotation of the LED circuit unit 70, enters the optical member 200 along the incident path "a" and then exits along the output path "b."

Accordingly, if the LED protrusion height differences Ha, Hb, Hc, and Hd are applied to any one of the external diameter 71, internal diameter 72, and front flat panel 73 of the chromatic aberration correction unit 50-1, the first LED chip 60A forms the incident path "a" based on the first thickness Ha of the first heat transfer member 90A, whereas the second LED chip 60B forms the incident path "a" based on the second thickness Hb of the second heat transfer member 90B subsequently to the first LED chip 60A. In the instant case, two or more LED chips may be turned on to form respective incident paths having a fine difference in the boundary portion of the same respective locations.

As a result, the incident path "a" of the first LED chip 60A and the incident path "a" of the second LED chip 60B are formed to have a light source-incident path difference between the LED protrusion height differences (Ha>Hc>Hb>Hd) based on the first thickness Ha and the second thickness Hb.

As a result, the light source-incident path difference between the LED protrusion height differences (Ha>Hc>Hb>Hd) can reduce or obviate chromatic aberration because the single output path "b" is formed in the optical member 200 by bringing focuses on the optical member 200 together.

Furthermore, if the LED protrusion height differences Ha, Hb, Hc, and Hd are applied to the front convex cone 74 (or the front concave cone 75) of the chromatic aberration correction unit 50-1, the first LED chip 60A forms the incident path "a" having the first thickness Ha of the first heat transfer member 90A (i.e., the protrusion reference location Z-Z of FIG. 6) in a forefront location. The second LED chip 60B forms the incident path "a" having the second thickness Hb of the second heat transfer member 90B subsequently to the first LED chip 60A.

Furthermore, the third LED chip 60C forms the incident path "a" at the back of the second LED chip 60B based on the third thickness Hc of the third heat transfer member 90C. The fourth LED chip 60D forms the incident path "a" at the back of the third LED chip 60C based on the fourth thickness Hd of the fourth heat transfer member 90D.

As a result, the light source paths "a" formed by the first, second, third, and fourth LED chips 60A, 60B, 60C, and 60D, respectively, have the light source-incident path difference between the LED protrusion height differences Ha, Hb, Hc, and Hd based on the second, third, and fourth thicknesses Hb, Hc, and Hd with respect to the first LED chip 60A of the first thickness Ha. In the instant case, two or more LED chips may be turned on to form respective incident paths having a fine difference in the boundary portion of the same respective locations.

As a result, the light source-incident path difference between the LED protrusion height differences Ha, Hb, Hc, and Hd can reduce or obviate chromatic aberration because the single output path "b" is formed in the optical member 200 by bringing focuses on the optical member 200 together.

As described above, in the rotation light source lamp system 200 applied to the vehicle 100 according to the exemplary embodiment of the present invention, the optical member 220 is combined with the rotation light source device 1 in which the chromatic aberration correction unit 50-1 obviates a focal distance difference, occurring due to any one of the external diameter PCB thickness differences "t1", "t2", "t3", and "t4", the internal diameter PCB thickness differences "t1", "t2", "t3", and "t4", the forward protrusion steps D1, D2, and D3, the LED front and rear distance differences La, Lb, and Lc or the LED radius distance differences R1, R2, and R3, and the LED protrusion height differences Ha, Hb, Hc, and Hd in the incident paths "a" of lights emitted by LED light sources upon turn-on when the plurality of first to N-th LED chips 60A, 60B, 60C, 60D, 60E, 60F, 60G, and 60N (N is an integer equal to or greater than 2) arrive at locations where they face the signal transmitter 80 and are sequentially synchronized, while the LED circuit unit 70 is rotated once by a current applied by the signal transmitter 80 to which a lamp turn-on signal is applied in the vehicle 100. Accordingly, chromatic aberration can be reduced by correcting a difference between the refractive indices of respective wavelengths having different colors for the first to N-th LED chips 60A, 60B, 60C, 60D, 60E, 60F, 60G, and 60N. In particular, since the first to N-th LED chips 60A, 60B, 60C, 60D, 60E, 60F, 60G, and 60N are rotated and turned on, a refractive index correction effect can be improved by a front and rear array difference between a violet-series LED having a short wavelength and a red-series LED having a long wavelength among various colors.

The rotation light source lamp system for reducing chromatic aberration applied to a vehicle according to various exemplary embodiments of the present invention implements the following actions and effects.

First, a chromatic aberration phenomenon can be solved, which may occur when various colors generated by a method for an LED chip array including a plurality of LED chips are implemented.

Second, optical efficiency can be improved because a high luminous flux and various colors are implemented in a small focus for the light source of an LED chip.

Third, two or more lamp functions, including T/SIG, DRL, POSITION, SIDE MARKER, TAIL, STOP, FOG, LOW, and HIGH, can be variously implemented because a plurality of LED chips not having a chromatic aberration phenomenon is used.

Fourth, weight and a production cost of a low pressure injection lens can be reduced because the focus of a light source is small and the size of the low pressure injection lens, such as a light guide, is small.

Fifth, chromatic aberration can be reduced because an optical path is different for each LED color.

Sixth, advantages of a rotation light source lamp including an LED chip array including a plurality of LED chips, such as improved optical efficiency, the generation of a high luminous flux using small consumption power, enhanced optical characteristics (e.g., a luminous flux/chromaticity/photoconversion rate) caused by a reduction in a fast junction temperature, the ease of securing remote performance of a light source caused by a small-sized lamp, the blocking of dazzling of a lamp light source from an oncoming vehicle/preceding vehicle and urban air mobility (UAM) by the cutoff of a shield, and a reduction in the weight/production cost of optical elements of a lamp, can be maintained without any change.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described in order to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A rotation light source lamp system including:

an optical member;

a signal transmitter; and a rotation light source device in which each of first to N-th light-emitting diode (LED) chips forming a circular array forms focal distance differences for the optical member, wherein the N is an integer equal to or greater than 2, wherein the focal distance differences enable incident paths of LED light sources which arrive at a location where each of the first to N-th LED chips faces the signal transmitter and are sequentially turned on while the first to N-th LED chips are rotated once to be directed toward one point forming a focus of the optical member, and form a single output path in the optical member.

2. The rotation light source lamp system of claim 1, wherein the focal distance differences are formed by a chromatic aberration correction unit using an LED circuit unit, wherein first to N-th chip grooves in which the first to N-th LED chips are disposed, respectively, are formed in an external diameter of the LED circuit unit, wherein the first to N-th chip grooves have different depths, and wherein the first to N-th LED chips have external diameter PCB thickness differences for the external diameter and form the chromatic aberration correction unit.

3. The rotation light source lamp system of claim 2, wherein the external diameter PCB thickness differences are set to bring the incident paths of the LED light sources of the first to N-th LED chips into the focus of the optical member.

4. The rotation light source lamp system of claim 2, wherein the LED circuit unit is connected to a rotation apparatus of receiving a rotational force from a power source which is driven by a current applied through a lamp turn-on signal for a vehicle from the signal transmitter and is rotated along with the rotation apparatus, and wherein the signal transmitter transmits an LED chip synchronization signal along with the current applied to the LED circuit unit so that light of an LED of an LED chip arriving at the location among the first to N-th LED chips is generated during the one rotation.

5. The rotation light source lamp system of claim 1, wherein the focal distance differences are formed by a chromatic aberration correction unit using an LED circuit unit, and wherein the chromatic aberration correction unit forms internal diameter PCB thickness differences in an internal diameter of the LED circuit unit or forward protrusion steps in one of a front flat panel, a front convex cone, and a front concave cone of the LED circuit unit.

6. The rotation light source lamp system of claim 5, wherein the internal diameter PCB thickness differences and the forward protrusion steps are set so that the first to N-th LED chips bring the incident paths of the LED light sources into the focus of the optical member.

7. The rotation light source lamp system of claim 5, wherein the internal diameter PCB thickness differences are formed by first to N-th chip grooves in which the first to N-th LED chips are disposed, respectively, based on the internal diameter of the LED circuit unit, and wherein the first to N-th chip grooves have different depths so that the first to N-th LED chips have protrusion height differences for the internal diameter, respectively.

8. The rotation light source lamp system of claim 5, wherein the forward protrusion steps are formed in first to N-th chip grooves in which the first to N-th LED chips are disposed, respectively, based on the front flat panel provided in a portion of the LED circuit unit, and wherein the first to N-th chip grooves have different depths so that the first to N-th LED chips have protrusion height differences for the front flat panel, respectively.

9. The rotation light source lamp system of claim 5, wherein the forward protrusion steps are formed in first to N-th chip grooves in which the first to N-th LED chips are disposed, respectively, based on the front convex cone or the front concave cone provided in one portion of the LED circuit unit, and wherein the first to N-th chip grooves have different depths so that the first to N-th LED chips have protrusion height differences for the front flat panel, respectively.

10. The rotation light source lamp system of claim 1, wherein the focal distance differences are formed by a chromatic aberration correction unit using an LED circuit unit, and wherein the chromatic aberration correction unit forms LED front and rear distance differences or LED radius distance differences in front of the LED circuit unit.

11. The rotation light source lamp system of claim 10, wherein the LED front and rear distance differences and the LED radius distance differences are set so that the first to N-th LED chips bring the incident paths of the LED light sources into the focus of the optical member, respectively.

12. The rotation light source lamp system of claim 10, wherein the LED front and rear distance differences include relative distance differences between a plurality of front distances in which the first to N-th LED chips are disposed, respectively, based on an external diameter of the LED circuit unit, and wherein the relative distance differences include front and rear distance differences for the front of the LED circuit unit.

13. The rotation light source lamp system of claim 10, wherein the LED radius distance differences include relative radius differences between a plurality of radius distance differences for the first to N-th LED chips formed in a front convex cone or a front concave cone provided in one portion of the LED circuit unit, and wherein the relative radius differences include radius differences for a center portion of the LED circuit unit.

14. The rotation light source lamp system of claim 1, wherein the focal distance differences are formed by a chromatic aberration correction unit using an LED circuit unit and a heat transfer member, and wherein the chromatic aberration correction unit forms one of external diameter LED protrusion height differences of the first to N-th LED chips using the heat transfer member attached to an external diameter of the LED circuit unit, internal diameter LED protrusion height differences of the first to N-th LED chips using the heat transfer member attached to an internal diameter of the LED circuit unit, and LED front protrusion height differences of the first to N-th LED chips using the heat transfer member attached to a front flat panel, a front convex cone or a front concave cone of the LED circuit unit.

15. The rotation light source lamp system of claim 14, wherein each of the external diameter LED protrusion height differences, the internal diameter LED protrusion height differences, and the LED front protrusion height differences is set so that the first to N-th LED chips bring the incident paths of the LED light sources into the focus of the optical member, respectively.

16. The rotation light source lamp system of claim 14, wherein the heat transfer member forms the external diameter LED protrusion height differences, the internal diameter LED protrusion height differences, and the LED front protrusion height differences by use of first to N-th heat transfer members matched with the first to N-th LED chips, respectively.

17. The rotation light source lamp system of claim 14, wherein each of the first to N-th heat transfer members includes a heat sink, and wherein the heat sink dissipates heat generated by the first to N-th LED chips.

18. The rotation light source lamp system of claim 14, wherein the optical member includes one of an aspherical lens, a low pressure injection lens, and a light guide.

19. A vehicle comprising:

a rotation light source lamp system in which a chromatic aberration correction unit is disposed in an LED circuit unit in which first to N-th LED chips having incident paths focused on one point of an optical member are circularly disposed, wherein the N is an integer equal to or greater than 2, wherein the chromatic aberration correction unit forms focal distance differences between the optical member and each of LED light sources which arrive at a location where each of the first to N-th LED chips faces a signal transmitter and is sequentially turned on while the first to N-th LED chips are rotated once based on one of thickness differences, steps, distance differences, and height differences, and brings the incident paths into a focus of the optical member based on the focal distance differences.

20. The vehicle of claim 19, wherein the thickness differences include external diameter PCB thickness differences for an external diameter of the LED circuit unit or internal diameter PCB thickness differences for an internal diameter of the LED circuit unit.

21. The vehicle of claim 19, wherein the steps include forward protrusion steps formed in one of a front flat panel, a front convex cone, and a front concave cone which shield one portion of the LED circuit unit.

22. The vehicle of claim 19, wherein the distance differences include LED front and rear distance differences forming relative location differences between the first to N-th LED chips in an external diameter of the LED circuit unit or LED radius distance differences forming relative radius differences between the first to N-th LED chips in a front convex cone provided in one portion of the LED circuit unit.

23. The vehicle of claim 19, wherein the height differences are formed by a heat transfer member to which the first to N-th LED chips are attached in one of an external diameter and an internal diameter of the LED circuit unit and a front flat panel, a front convex cone, and a front concave cone which shield one portion of the LED circuit unit.

24. The vehicle of claim 19, wherein the rotation light source lamp system is one of a head lamp, a tail lamp, a stop lamp, a side marker lamp, a high mounted stop lamp (HMSL), and an urban air mobility (UAM) lamp.

25. The vehicle of claim 19, wherein the optical member includes one of an aspherical lens, a low pressure injection lens, and a light guide.

* * * * *